US008471757B2

(12) United States Patent
Yonemoto et al.

(10) Patent No.: US 8,471,757 B2
(45) Date of Patent: Jun. 25, 2013

(54) DEVICE USING DIELECTRIC LENS

(75) Inventors: Naruto Yonemoto, Fuchu (JP); Motoharu Matsuzaki, Tokyo (JP)

(73) Assignees: Electronic Navigation Research Institute, An Independent Administrative Institution, Tokyo (JP); Lenstar Co., Ltd., Chiba (JP)

( * ) Notice: Subject to any disclaimer, the term of this patent is extended or adjusted under 35 U.S.C. 154(b) by 915 days.

(21) Appl. No.: 11/574,012

(22) PCT Filed: Jul. 27, 2005

(86) PCT No.: PCT/JP2005/013743

§ 371 (c)(1),
(2), (4) Date: Jun. 29, 2009

(87) PCT Pub. No.: WO2006/018956

PCT Pub. Date: Feb. 23, 2006

(65) Prior Publication Data

US 2009/0302239 A1 Dec. 10, 2009

(30) Foreign Application Priority Data

Aug. 19, 2004 (JP) ..... 2004-239223
Jan. 18, 2005 (JP) ..... 2005-010582

(51) Int. Cl.
*H01Q 15/08* (2006.01)
*H01Q 15/14* (2006.01)
*H01Q 15/23* (2006.01)
*H01Q 15/00* (2006.01)

(52) U.S. Cl.
USPC ..... 342/11; 342/5; 343/700 R; 343/907; 343/909; 343/911 R; 343/912; 340/907

(58) Field of Classification Search
USPC ..... 342/5–11, 175, 70; 343/700 R, 753–755, 343/907, 909, 910, 911 R, 911 L, 772, 783, 700 MS, 912–916; 340/907
See application file for complete search history.

(56) References Cited

U.S. PATENT DOCUMENTS 2,479,673 A * 8/1949 De Vore ..... 343/783
3,255,453 A * 6/1966 Horst ..... 343/754

(Continued)

FOREIGN PATENT DOCUMENTS

JP 52-108144 9/1977
JP 62-213304 9/1987

(Continued)

OTHER PUBLICATIONS

N. Strobel, "Reflector Telescopes"; posted on the Internet at astronomynotes.com; no date given; last updated on Jan. 7, 2011.*

(Continued)

*Primary Examiner* — Bernarr Gregory
(74) *Attorney, Agent, or Firm* — Griffin & Szipl, P.C.

(57) ABSTRACT

The invention relates to a dielectric lens useable in both the radio wave band and the light wave band, and a device using this dielectric lens. The device comprises a dielectric lens formed of a transparent dielectric member small in dielectric loss and having an omnidirectional feature with regard to an electromagnetic wave, a transparent dielectric shell that is hollow inside and having the radius that is equal to the focal distance of the dielectric lens, and a holding mechanism for positioning and holding the dielectric shell and the dielectric lens so as to locate the dielectric shell at a position along the focal distance with the dielectric lens included at the inner center of this dielectric shell. The device is provided, at the focal point of the dielectric lens, with a reflector for reflecting an electromagnetic wave or a generator for generating an electromagnetic wave.

39 Claims, 19 Drawing Sheets

U.S. PATENT DOCUMENTS

| | | | | | |
|---|---|---|---|---|---|
| 3,329,958 | A * | 7/1967 | Anderson | 343/753 |
| 3,430,249 | A * | 2/1969 | Franks | 343/911 R |
| 3,550,147 | A * | 12/1970 | Ochiai | 343/911 R |
| 3,852,762 | A * | 12/1974 | Henf et al. | 343/783 |
| 3,860,927 | A * | 1/1975 | Ota et al. | 342/11 |
| 3,866,234 | A * | 2/1975 | Gates et al. | 343/911 R |
| 3,935,577 | A * | 1/1976 | Hansen | 343/783 |
| 4,187,507 | A * | 2/1980 | Crane et al. | 343/754 |
| 5,430,444 | A * | 7/1995 | Rix et al. | 342/11 |
| 5,905,457 | A * | 5/1999 | Rashid | 342/70 |
| 5,952,984 | A * | 9/1999 | Kuramoto et al. | 343/911 R |
| 5,978,157 | A * | 11/1999 | Matthews | 343/911 R |
| 6,023,246 | A * | 2/2000 | Tanabe | 343/753 |
| 6,052,087 | A * | 4/2000 | Ishikawa et al. | 343/700 MS |
| 6,356,246 | B1 * | 3/2002 | Nakamura et al. | 343/911 R |
| 6,366,245 | B1 * | 4/2002 | Schmidt et al. | 343/700 MS |
| 6,480,160 | B1 * | 11/2002 | Bjornholt et al. | 343/754 |
| 6,590,544 | B1 * | 7/2003 | Filipovic | 343/753 |
| 7,310,061 | B2 * | 12/2007 | Nagasaku et al. | 342/175 |

FOREIGN PATENT DOCUMENTS

| | | |
|---|---|---|
| JP | 62-234405 | 10/1987 |
| JP | 7-505018 | 6/1995 |
| JP | 2001-044746 | 2/2001 |
| JP | 2001-102857 | 4/2001 |

OTHER PUBLICATIONS

Hans C. Ohanian, Physics 810-812 (W.W. Norton & Company, Inc. 1985), filed herewith as Exhibit A.

* cited by examiner (a) When the light of s polarization enters to entrance plane (b) When the light of p polarization enters to entrance plane

DEVICE USING DIELECTRIC LENS

This is a National Phase Application in the United States of International Patent Application No. PCT/JP2005/13743 filed Jul. 27, 2005, which claims priority on Japanese Patent Application No. 2004-239223, filed Aug. 19, 2004 and Japanese Application No. 2005-010582 filed Jan. 18, 2005. The entire disclosures of the above patent applications are hereby incorporated by reference.

FIELD OF THE INVENTION

This invention relates to a device using a dielectric lens transparent to electromagnetic waves. Particularly, this invention relates to a device using a dielectric lens suitable for the microwave band, the millimeter wave band, and the visible light wave band. This invention further relates to a reflector, generator, and traffic signal, in the field of application of the device using the dielectric lens.

BACKGROUND OF THE INVENTION

Generally, electromagnetic waves which propagate in space can be long waves, medium frequency waves, microwaves, millimeter waves, infrared light, ultraviolet rays, X-rays, and gamma rays. The electromagnetic waves of each band are used in many fields. Regarding electromagnetic waves in these bands, the electromagnetic waves of the light wave band of the range of 380-760 mm wavelength are visible light to human eyes. Electromagnetic waves from the millimeter wave band to the light wave band are now beginning to be used in the field of communications.

Conventionally, metal reflecting plates are used for the reflecting plate of the millimeter wave band used by the telecommunications sector. However, when using this reflecting plate with a light wave band, in order to form rectangular-type shapes like a cube corner, high angle accuracy is required. Similarly, in order to form the surface smoothly, high surface smoothness is required. A dielectric lens which has omnidirectionality is used where the wavelength of electromagnetic waves is longer than the millimeter wave band. One such dielectric lens is a Luneberg lens formed by adjusting a dielectric constant with styrene foam, etc.

As an example of a device which uses a spherical dielectric lens, the Luneberg lens is used as an antenna. As shown in FIG. 25, in antenna device 111, foam material layer 134 is formed by filling up a foam material between spherical lens 114 and radome 133. This foam material layer 134 has combined spherical lens 114 and radome 133. Thus, spherical lens 114 has structure held at radome 133. Such a device is illustrated in patent document JP 2001-102857 A.

PROBLEM(S) TO BE SOLVED BY THE INVENTION

However, when conventional metal reflecting plates are used for light waves and the millimeter wave band, the null point of the pattern appears in both ends within the limits of 90 degrees according to the structure of a reflecting plate. The reflecting plate of such a structure cannot obtain the wide angle characteristic of 80 degrees or more. When the Luneberg lens currently formed with styrene foam, etc., as an omnidirectional reflector is used, there is a problem that light cannot be reflected in this reflector.

When a Luneberg lens is used as an antenna, the circumference of this Luneberg lens is protected by the radome.

However, when the wavelength of electromagnetic waves is shorter than the millimeter wave band (frequency of 30-300 GHz), the electromagnetic waves that enter into the antenna arranged in the radome are influenced by shielding of electromagnetic waves, absorption of electromagnetic waves, dispersion of electromagnetic waves, etc., by the frame member which comprises a radome.

As a result, there is a problem in that loss of electromagnetic waves increases. Therefore, when a Luneberg lens is used as an antenna, there is a problem that the electromagnetic waves of a certain direction cannot be received or reflected.

When the wavelength of electromagnetic waves is shorter than the millimeter wave band (frequency of 30-300 GHz), in order to suppress loss of electromagnetic waves, it is necessary to form surface protection material thinly in the opening of the antenna. When dielectric loss uses a large material as surface protection material, it is necessary to form surface protection material especially thinly. However, when surface protection material is formed thinly, there is a problem that the mechanical strength becomes weak. Therefore, in the millimeter wave band, there is a radome which uses Teflon®, a material with little dielectric loss, as a frame member. Thus, the dielectric used as the material of the frame member have high weight density. Therefore, when such dielectric are used as frame member, there is a problem that the radome becomes very heavy.

As shown in FIG. 25, FRP is used as surface protection material of radome 133 and a general radome. FRP is lightweight and is strong to tension, bending, compression, etc. Therefore, while FRP performs excellently as a structural material, it has the following faults. That is, in the manufacturing process of FRP, roughness and fineness occur on the glass fiber which is one of the components of FRP. By the roughness and fineness of this glass fiber, there is a problem in that the dielectric constant of resin (which is also one of the components of FRP), and that of this glass fiber, are different.

When the wavelength of electromagnetic waves is shorter than the millimeter wave band (frequency of 30-300 GHz), and when the dielectric constant of each component which comprises FRP is different, there is a problem that dispersion of electromagnetic waves and the loss of electromagnetic waves which enter into the antenna arranged in the radome increase remarkably. There is a problem that it becomes difficult to obtain surface protection material, such as FRP, which has uniform composition on the whole radome surface. The beam characteristic of the electromagnetic waves which enter into the radome changes with frequency.

As shown in FIG. 25, when the wavelength of electromagnetic waves is shorter than the millimeter wave band (frequency of 30-300 GHz), the styrene foam currently used for foam material layer 134 becomes a cause by which loss of received electromagnetic waves increases, and this styrene foam has the problem that it cannot be used with the light wave band. With a band where the wavelength of electromagnetic waves is short, particularly in the antenna opening, there is a technical issue between loss of electromagnetic waves and the mechanical strength of a member.

Thus, the device using a dielectric lens has many problems. There is a need for a device using the dielectric lens which can be used for both a millimeter wave band and a light wave band in fields, such as communication and broadcast. There is a need for a device using a dielectric lens without dispersion of electromagnetic waves, and loss of electromagnetic waves.

There is a need for various devices in the field of application of devices using a dielectric lens.

SUMMARY OF THE INVENTION

Means for Solving the Problem

The invention, in accordance with a first illustrative embodiment, is a device using a dielectric lens, comprising a dielectric lens, a dielectric shell, and a maintenance mechanism.

The dielectric lens is transparent to electromagnetic waves. The dielectric shell is transparent, has a hollow inside, and a radius of one surface of this hollow inside is equal to the focal length of the dielectric lens. The maintenance mechanism is disposed to carry out position maintenance of the dielectric shell and the dielectric lens so that the dielectric lens may be included in the internal central part of the dielectric shell and the dielectric shell may be located by the maintenance mechanism along the focal length of the dielectric lens.

Since it is constituted in this way, the invention of the first illustrative embodiment has the following effects. Since each of dielectric lens and dielectric shell is formed by a transparent member, they act as a lens which has omnidirectionality to the electromagnetic waves of not only the millimeter wave band but also the light wave band. Since the surface of the dielectric shell is located along the focal length of the dielectric lens, the electromagnetic wave reflecting body can reflect, and the electromagnetic wave receiving section can receive, electromagnetic waves, optionally along all directions around 360-degrees. Therefore, an electromagnetic wave reflecting device and electromagnetic wave receiving device is provided having omnidirectionality. Because the device does not need a power supply, so that once it is installed, it can be used semi-perpetually.

The dielectric lens is held at a state where it is fixed strongly with supporting structure inside the dielectric shell. Thus, vibration at the time of using the device using the dielectric lens, such as, for example an earthquake, etc., does not cause the dielectric lens to move inside, and destruction, damage, mechanical modification, etc., do not occur. The surface of a dielectric lens is not damaged by external factors, such as rainstorms, or sudden phenomena under measurement, and mechanical modification is not generated, either. Therefore, distortion of the electromagnetic lens to the entering of electromagnetic waves does not occur. The focal length to the entering electromagnetic waves is also not changed. A device using the dielectric lens is little influenced by shielding of electromagnetic waves, absorption of electromagnetic waves, or dispersion of electromagnetic waves by the dielectric shell. The device using the dielectric lens is strong and lightweight.

The invention, in accordance with a second illustrative embodiment, is a device using the dielectric lens comprising a dielectric lens, a dielectric shell, and a maintenance mechanism. The dielectric lens is transparent to electromagnetic waves. The dielectric shell is transparent and had a hollow inside. A radius of one surface of this hollow inside is equal to the focal length of a dielectric lens. The maintenance mechanism carries out position maintenance of the dielectric shell and the dielectric lens so that the dielectric lens may be included in the internal central part of a dielectric shell and the dielectric shell may be located by the maintenance mechanism along the focal length of the dielectric lens. The dielectric lens is a single structure with specific inductive capacity of 3.5 or less formed with transparent dielectric.

Since it is constituted in this way, the invention of the second illustrative embodiment has the same effects as that of first illustrative embodiment. The specific inductive capacity of the optimal dielectric member of a dielectric lens is 3.5 or less as shown in FIG. 6.

The invention concerning a third illustrative embodiment is a device using a dielectric lens, comprising a dielectric lens, a dielectric shell, and a maintenance mechanism. The dielectric lens is transparent to electromagnetic waves. The dielectric shell is transparent and has a hollow inside, and the radius of one surface of this hollow inside is equal to the focal length of the dielectric lens. The maintenance mechanism carries out position maintenance of the dielectric shell and the dielectric lens so that the dielectric lens may be included in the internal central part of the dielectric shell and the dielectric shell may be located by the maintenance mechanism along the focal length of the dielectric lens. The dielectric lens is a single structure with a specific inductive capacity of 3.5 or less formed with transparent dielectric. A dielectric coating is provided on at least one surface of the dielectric lens or the dielectric shell. The specific inductive capacity of this dielectric coating is one or more, and a dielectric coating is formed by transparent dielectric material with a dielectric constant smaller than the dielectric constant of a dielectric lens or a dielectric shell.

Since it comprised in this way, the invention of the third illustrative embodiment has the same effects as that of first illustrative embodiment and the second illustrative embodiment. The transmissivity of electromagnetic waves becomes good with a dielectric coating.

In the invention of the second illustrative embodiment and the third illustrative embodiment, the dielectric shell of the device using the dielectric lens of the fourth illustrative embodiment is formed by a transparent dielectric member, and the dielectric shell is a multi-layered structure formed in a gap interposed between concentric hollows. The radius of one spherical surface of the dielectric shell of this multi-layered structure has a length equal to the focal length of the dielectric lens. The maintenance mechanism carries out position maintenance of the dielectric shell and dielectric lens of the multi-layered structure so that the radius of one spherical surface of the dielectric shell of multi-layered structure may be located in the focal length of the dielectric lens.

Since it constituted in this way, the invention of the fourth illustrative embodiment has the same effects as that of second illustrative embodiment and the third illustrative embodiment. Since a dielectric shell of multi-layered structure is used, the dielectric shell of this multi-layered structure can have an effective aperture area to project area larger than a dielectric shell of monolayer structure.

The invention concerning a fifth illustrative embodiment is a device using a dielectric lens comprising a dielectric lens, a dielectric shell, and a maintenance mechanism. The dielectric lens is transparent to electromagnetic waves. The dielectric shell is transparent and has a hollow inside, and the radius of one surface of this hollow inside has a radius equal to the focal length of the dielectric lens. The maintenance mechanism carries out position maintenance of the dielectric shell and the dielectric lens so that the dielectric lens may be included in the internal central part of the dielectric shell and the dielectric shell may be located by the maintenance mechanism along the focal length of the dielectric lens. Each surface of a dielectric shell has a radius beyond the distance calculated from the focal length of the dielectric lens.

Since it constituted in this way, the invention of fifth illustrative embodiment has the same effects as that of first illustrative embodiment. The surface of a dielectric shell is safe, without heating the dielectric shell, since convergence of the electromagnetic waves by the dielectric lens is avoidable.

In the invention of the first illustrative embodiment and the second illustrative embodiment, the invention of the sixth illustrative embodiment is a device using the dielectric lens that provides an electromagnetic wave reflecting section in the focal length of the dielectric lens.

Since it constituted in this way, the invention of sixth illustrative embodiment has the same effects as that of the first illustrative embodiment and the second illustrative embodiment. A device which reflects electromagnetic waves having omnidirectionality is thus obtained. This device does not need a power supply, thus once installed, it can be used semi-perpetually as a device which reflects electromagnetic waves. Therefore, this device can be installed in any place, such inside a mountain, in a desert, and a temporary runway can also be prepared easily at a place without an airport. When using it as a radar apparatus, this device can be used also as a marker for automatic guidance.

In the invention of the first illustrative embodiment and the second illustrative embodiment, the invention of the seventh illustrative embodiment is a device using the dielectric lens which provides the electromagnetic wave receiving section in the focal length of the dielectric lens.

Since it constituted in this way, the invention of the seventh illustrative embodiment has the same effects as the first illustrative embodiment and the second illustrative embodiment. A device which receives electromagnetic waves having omnidirectionality is thus obtained.

In the invention of the first illustrative embodiment and the second illustrative embodiment, the invention of the eighth illustrative embodiment is a device using the dielectric lens which has an electromagnetic wave reflecting section, and an electromagnetic wave receiving section in the focal length of the dielectric lens.

Since it constituted in this way, the invention of eighth illustrative embodiment has the same effects as that of first illustrative embodiment and the second illustrative embodiment. This device can be used as a device which reflects electromagnetic waves omnidirectionally, and can be used as a device which also receives electromagnetic waves omnidirectionally.

The invention, in accordance with a ninth illustrative embodiment, is a device using the dielectric lens comprising a dielectric lens, a dielectric shell, and a maintenance mechanism.

The dielectric lens is transparent to electromagnetic waves. The dielectric shell is transparent and has a hollow inside, and the radius of one surface of this hollow inside is equal to the focal length of the dielectric lens. The maintenance mechanism carries out position maintenance of the dielectric shell and the dielectric lens so that the dielectric lens may be included in the internal central part of the dielectric shell and the dielectric shell may be located by the maintenance mechanism along the focal length of the dielectric lens. The thickness of the dielectric shell is formed with polycarbonate resin of 3 m or less.

Since it constituted in this way, the invention of the ninth illustrative embodiment has the same effects as that of the first illustrative embodiment. Since the dielectric shell is formed with polycarbonate resin of 3 mm or less, this device can maintain high strength to a local load, and this device can also maintain weather resistance.

The invention concerning a tenth illustrative embodiment is a device using the dielectric lens comprising a dielectric lens, a dielectric shell, and a maintenance mechanism. The dielectric lens is transparent to electromagnetic waves. The dielectric shell is transparent and has a hollow inside, and the radius of one surface of this hollow inside is equal to the focal length of the dielectric lens. The maintenance mechanism carries out position maintenance of the dielectric shell and the dielectric lens so that the dielectric lens may be included in the internal central part of the dielectric shell and the dielectric shell may be located by the maintenance mechanism along the focal length of the dielectric lens. The thickness of the dielectric shell is formed with acrylic resin of 3 nm or less.

Since it constituted in this way, the invention of the tenth illustrative embodiment has the same effects as that of first illustrative embodiment. Since the dielectric shell is formed with acrylic resin of 3 m or less, this device can maintain high strength also to a local load, and this device can further maintain weather resistance.

The invention, in accordance with an eleventh illustrative embodiment, is a device using the dielectric lens comprising a dielectric lens, a dielectric shell, and a maintenance mechanism. The dielectric lens is transparent to electromagnetic waves. The dielectric shell is transparent and has a hollow inside, and the radius of one surface of this hollow inside is equal to the focal length of a dielectric lens. The maintenance mechanism carries out position maintenance of the dielectric shell and the dielectric lens so that the dielectric lens may be included in the internal central part of the dielectric shell and the dielectric shell may be located by the maintenance mechanism along the focal length of the dielectric lens. The dielectric lens is a single structure having specific inductive capacity formed with 3.5 or less transparent dielectrics. The thickness of the dielectric shell is formed with polycarbonate resin of 3 m or less.

Since it constituted in this way, the invention of the eleventh illustrative embodiment has the same effects as the first illustrative embodiment and the second illustrative embodiment. Since the dielectric shell is formed with polycarbonate resin of 3 mm or less, this device can maintain weather resistance while also being able to maintain high strength to a local load.

The invention concerning a twelfth illustrative embodiment is a device using the dielectric lens comprising a dielectric lens, a dielectric shell, and a maintenance mechanism. The dielectric lens is transparent to electromagnetic waves. The dielectric shell is transparent and has a hollow inside, and the radius of one surface of this hollow inside is equal to the focal length of the dielectric lens. The maintenance mechanism carries out position maintenance of the dielectric shell and the dielectric lens so that the dielectric lens may be included in the internal central part of the dielectric shell and the dielectric shell may be located by the maintenance mechanism along the focal length of the dielectric lens. The dielectric lens is a single structure which specific inductive capacity of 3.5 or less formed with transparent dielectrics, and the thickness of the dielectric shell is formed with acrylic resin of 3 mm or less.

Since it constituted in this way, the invention of twelfth illustrative embodiment has the same effects as that of first illustrative embodiment and the second illustrative embodiment. Since the dielectric shell is formed with acrylic resin of 3 mm or less, this device can maintain weather resistance while being able to maintain high strength also with respect to a local load.

In the invention of the second illustrative embodiment, the eleventh illustrative embodiment, and the twelfth illustrative embodiment, the invention concerning a thirteenth illustrative embodiment is a device using the dielectric lens having a dielectric lens with transparent polystyrene resin.

Since it constituted in this way, the invention concerning the thirteenth illustrative embodiment has the same effects as the second illustrative embodiment, the eleventh illustrative embodiment, and the twelfth illustrative embodiment.

The invention, in accordance with a fourteenth illustrative embodiment, is a device (it is hereafter described as a reflector), which reflects the electromagnetic waves using the dielectric lens, comprising a dielectric lens, a reflecting body, and a position maintenance means. The dielectric lens is transparent to electromagnetic waves. The reflecting body is provided in the focal length of the dielectric lens. The position maintenance means carries out position maintenance of the electromagnetic wave reflecting body at the focal length of the dielectric lens, and the position maintenance means comprises a dielectric shell and a maintenance mechanism. The dielectric shell has an inside diameter or an outer diameter equal to the focal length, it is formed by a member transparent to electromagnetic waves, and is formed in a hollow which can store the dielectric lens inside. The maintenance mechanism carries out position maintenance of the dielectric shell and the dielectric lens, so that this dielectric shell may include the dielectric lens and the dielectric shell may be located along the focal length of a dielectric lens. In the reflective surface of the reflecting body, either of a color filter, or a liquid crystal, or both, are arranged.

Since it constituted in this way, the device of the invention of the fourteenth embodiment acts as a lens to electromagnetic waves of not only millimeter wave band but of the light wave band, as well. A reflector without the necessity for a power supply can thus be obtained. By choosing the color of the color filter arranged on the reflective surface of the reflecting body, or by choosing the liquid crystal, a reflector provided with a coloring function to reflect desired colors is obtained. Since this reflector does not need a power supply, once it is installed, it can be used semi-perpetually. Since the circumference of the dielectric lens is surrounded with dielectric shell transparent to electromagnetic waves, the surface of the lens is protected and breakage, damage, mechanical modification, etc., do not occur.

The invention concerning a fifteenth illustrative embodiment is a reflector using the dielectric lens comprising a dielectric lens, an electromagnetic wave reflecting body, and a position maintenance means. The dielectric lens is transparent to electromagnetic waves. The electromagnetic wave reflecting body is provided in the focal length of the dielectric lens.

The position maintenance means carries out position maintenance of the reflecting body at the focal length of the dielectric lens, and a position maintenance means comprises a cylindrical container and a maintenance mechanism. The cylindrical container is formed by a member transparent to electromagnetic waves, has an inside diameter or outer diameter equal to a focal length of a dielectric lens, and forms the dielectric lens in an a hollow inside in which storage of two or more lens is possible. The maintenance mechanism carries out position maintenance of the cylindrical container and each dielectric lens so that the cylindrical container may include a dielectric lens and the cylindrical container may be located along the focal length of each dielectric lens.

Since it constituted in this way, the long bar reflector which has arbitrary length can be manufactured by the invention of the fifteenth illustrative embodiment. This reflector is installed on a road and can be used as a road sign without the necessity for a power supply. Since this reflector does not need a power supply, once it is installed, it can be used semi-perpetually. Therefore, it can also be installed in places in which an electric supply line is not installed, such as a mountain range and a desert, or as a road sign or a guide light. By installing in a place without an airport as the guide light, a temporary runway can be prepared easily. When using this reflector as a radar apparatus, it can also be used as a marker for guiding a movable body, or the like, automatically.

The invention, in accordance with a sixteenth illustrative embodiment, is a reflector using a dielectric lens, comprising a dielectric lens, an electromagnetic reflecting body, and a position maintenance means. The dielectric lens is transparent to electromagnetic waves.

The electromagnetic reflecting body is provided in the focal length of the dielectric lens, and the position maintenance means carries out position maintenance of the reflecting body at the focal length of the dielectric lens.

The reflecting body which has a slit, by using a the reflecting body with a slit or separated metal pieces the device has the function of detecting the direction from which the electromagnetic waves are reflected from the slit.

Since it is comprised in this way, in the movable body side emitting electromagnetic waves with the reflector of the invention of the sixteenth illustrative embodiment, distance, direction, etc., of a movable body can be measured by the reflected wave from the movable body side on the basis of the gap of the slit, the direction of the slit, or the separation of the metal pieces. By detecting the reflective electromagnetic waves from the slit, the reflector has the function of detecting the reflective direction.

The invention, in accordance with a seventeenth illustrative embodiment, is a reflector using the dielectric lens comprising a dielectric lens, an electronic wave reflecting body, and a position maintenance means.

The dielectric lens is transparent to electromagnetic waves. The electromagnetic reflecting body is disposed in the focal length of the dielectric lens. The position maintenance means carries out position maintenance of the reflecting body at the focal length of the dielectric lens, and this position maintenance means comprises a maintenance mechanism that carries out position maintenance of the dielectric lens, and a case that includes the dielectric lens. The maintenance mechanism carries out position maintenance of the dielectric lens so that the reflecting body may be located along the focal length of a dielectric lens. One end of the case has a maintenance mechanism, the other end of the case is opened wide or the other end of the case is covered with a cover object formed by a member transparent to electromagnetic waves.

Since it is constituted in this way, when using the reflector of the invention of the seventeenth illustrative embodiment for a radar installation, it can also be used as a marker for automatic guidance. The invention can be used also as a brake light for movable bodies, such as a car. If the reflector using two or more dielectric lenses is arranged in a case, a whole large-sized reflector can be formed. Since the dielectric lens is held fixed strongly in the case, destruction, damage, mechanical modification, and the like do not accrue on the surface of the dielectric lens.

The invention concerning an eighteenth illustrative embodiment is a reflector using the dielectric lens comprising a dielectric lens, an electromagnetic wave reflecting body, and a position maintenance means. The dielectric lens is transparent to electromagnetic waves. The reflecting body is provided in the focal length of the dielectric lens. The position maintenance means carries out position maintenance of the reflecting body at the focal length of the dielectric lens. An electric control reflecting body that can control electromagnetic waves is provided in the reflecting body.

The solar cell used as a power supply is disposed in the electric control reflecting body.

Since it constituted in this way, a power supply is perpetually supplied to the electric control reflecting body of the invention of the eighteenth illustrative embodiment by sun rays. Therefore, once it is installed, one obtains, semi-perpetually, a reflector which has an electric control function in which it is not necessary to supply electric power. This device can also be installed in places, such as the inside of a mountain, or a desert. A temporary runway can be easily prepared by installing such as the guide light at a place without an airport. When using this device as a radar apparatus, it can be used also as a marker for guiding a movable body or the like automatically.

This device can be used as the radio wave LGT in the ground or for marine use, or a range marker.

In the invention of the fifteenth, sixteenth and seventeenth illustrative embodiments, the invention of a nineteenth illustrative embodiment provides either a color filter, or a liquid crystal, or both, in the reflective surface of the reflecting body.

Since it constituted in this way, the invention of the nineteenth illustrative embodiment has the same effects as the fifteenth, sixteenth and seventeenth illustrative embodiments. The reflector of arbitrary colors is obtained by choosing as desired the color of the color filter arranged in the reflective surface of the reflecting body.

The invention, in accordance with a twentieth illustrative embodiment, is a reflector using a dielectric lens, comprising a dielectric lens, an electromagnetic wave reflecting body, and a position maintenance means. The dielectric lens is transparent to electromagnetic waves.

The reflecting body is provided in the focal length of this dielectric lens. The position maintenance means carries out position maintenance of this reflecting body at the focal length of a dielectric lens. The position maintenance means consists of a dielectric shell and a maintenance mechanism. The dielectric shell has an inside diameter or an outer diameter equal to a focal length, forms it by a member transparent to electromagnetic waves, and is formed in the hollow inside that can store the dielectric lens. The maintenance mechanism carries out position maintenance of a dielectric shell and the dielectric lens so that this dielectric shell may include a dielectric lens and a dielectric shell may be located along the focal length of a dielectric lens. In the reflective surface of a reflecting body, either a color filter, or a liquid crystal, or both are arranged. When the liquid crystal has been arranged on the reflective surface of the reflecting body, the solar cell used as a power supply is disposed in the reflecting body.

Since it constituted in this way, the invention of twentieth illustrative embodiment has the same effects as that of fourteenth illustrative embodiment. Since electric power is supplied to the power supply for the liquid crystals of this reflector from a solar cell, it does not need a special power supply but it can be used semi-perpetually with the solar cell.

The invention concerning a twenty-first illustrative embodiment is a reflector using the dielectric lens comprising a dielectric lens, an electromagnetic wave reflecting body, and a position maintenance means. The dielectric lens is transparent to electromagnetic waves. The reflecting body is provided in the focal length of this dielectric lens. The position maintenance means carries out position maintenance of the reflecting body at the focal length of the dielectric lens.

An electric control reflecting body that can control electromagnetic waves is provided in the reflecting body.

A solar cell used as a power supply is allocated in the electric control reflecting body. The position maintenance means comprises a dielectric shell and a maintenance mechanism. The dielectric shell has an inside diameter or an outer diameter equal to a focal length, and it is formed in the hollow inside which can store a dielectric lens by a member transparent to electromagnetic waves. The maintenance mechanism carries out position maintenance of the dielectric shell and the dielectric lens so that this dielectric shell may include a dielectric lens, and the dielectric shell may be located along the focal length of a dielectric lens.

Since it constituted in this way, the invention of the twenty-first illustrative embodiment has the same effects as that of the eighteenth illustrative embodiment. Since the circumference of the dielectric lens of this reflector is surrounded with the dielectric shell transparent to electromagnetic waves, breakage, damage, mechanical modification, etc., do not occur on the surface of the dielectric lens.

The invention, in accordance with a twenty-second illustrative embodiment, is a reflector using a dielectric lens, comprising a dielectric lens, an electromagnetic wave reflecting body, and a position maintenance means. The dielectric lens is transparent to electromagnetic waves. The reflecting body is provided in the focal length of the dielectric lens. The position maintenance means carries out position maintenance of the reflecting body at the focal length of the dielectric lens. And the position maintenance means comprises a dielectric shell and a maintenance mechanism. The dielectric shell has an inside diameter or an outer diameter equal to a focal length, it is formed by a member transparent to electromagnetic waves, and is formed in a hollow that can store the dielectric lens. The maintenance mechanism carries out position maintenance of the dielectric shell and the dielectric lens so that this dielectric shell may include the dielectric lens and the dielectric shell may be located along the focal length of the dielectric lens. On the reflective surface of the reflecting body, either of a color filter, or a liquid crystal, or both, are arranged. For a position maintenance means, the shade cap which intercepts the sun rays irradiate a dielectric lens is arranged.

Since it constituted in this way, the invention of the twenty-second illustrative embodiment has the same effects as the fourteenth illustrative embodiment. Since the sun rays irradiating the dielectric lens are covered with a shade cap, they can avoid convergence of the sun rays by the dielectric lens on the surface of the position maintenance means. Therefore, since the position maintenance means is not heated, this reflector is safe.

The invention, in accordance with a twenty-third illustrative embodiment, is a reflector using a dielectric lens, comprising a dielectric lens, an electromagnetic wave reflecting body, and a position maintenance means. The dielectric lens is transparent to electromagnetic waves. The reflecting body is provided in the focal length of the dielectric lens. The position maintenance means carries out position maintenance of the reflecting body at the focal length of the dielectric lens. And the position maintenance means comprises a dielectric shell and a maintenance mechanism. The dielectric shell has an inside diameter or an outer diameter equal to a focal length, and is formed by a member transparent to electromagnetic waves, and is formed in a hollow inside that can store the dielectric lens, and the dielectric shell includes a dielectric lens. And the maintenance mechanism carries out position maintenance of the dielectric shell and the dielectric lens so that the dielectric shell may be located along the focal length of a dielectric lens. In the reflective surface of the reflecting body, either of a color filter, or a liquid crystal, or both, are arranged. For the position maintenance means, light scattering material is arranged instead of a shade cap. This light scattering material is formed with a material that has a light scattering characteristic.

Since it constituted in this way, the invention concerning twenty-third illustrative embodiment has the same effects as the fourteenth illustrative embodiment. Since sun rays are scattered by light scattering material, this reflector can avoid convergence of the sun rays to the focus by the dielectric lens. Since the position maintenance means is not heated by the focal length of the dielectric lens in the reflecting body, the reflector is safe.

In the inventions of the seventeenth illustrative embodiment and the eighteenth illustrative embodiment, the invention of a twenty-fourth illustrative embodiment is a reflector using the dielectric lens which provides a window in the position maintenance means and has arranged either of a color filter, a liquid crystal, or both, in this window.

Since it constituted in this way, the invention of the twenty-fourth illustrative embodiment has the same effects as the seventeenth illustrative embodiment and the eighteenth illustrative embodiment. The reflector of discretionary colors is obtained by discretionarily choosing the color of the color filter arranged at a window.

The invention, in accordance with a twenty-fifth illustrative embodiment, is a radiation device (it is hereafter described as a generator) of electromagnetic waves using the dielectric lens comprising a dielectric lens, an electromagnetic wave generating body, and a position maintenance means. The dielectric lens is transparent to electromagnetic waves. The electromagnetic wave generating body which emits electromagnetic waves is provided in the focal length of the dielectric lens.

The position maintenance means carries out position maintenance of the generating body at the focal length of the dielectric lens, and the position maintenance means comprises a cylindrical container and a maintenance mechanism. The cylindrical container is formed by a member transparent to electromagnetic waves, and it has an inside diameter or an outer diameter equal to a focal length, and forms a hollow inside that can store two or more dielectric lenses, and this cylindrical container includes a dielectric lens. A maintenance mechanism carries out position maintenance of a cylindrical container and each dielectric lens so that a cylindrical container may be located along the focal length of each dielectric lens.

Since it constituted in this way, according to the invention of the twenty-fifth illustrative embodiment, a generator of the long band electromagnetic waves having a pre-desired length can be manufactured. If this generator is installed on a road, this generator can be used as a road sign which does not need a supply of electric power in the form of a power supply and which emits electromagnetic waves. Since this generator does not need a power supply, once it is installed, it can be used semi-perpetually. Therefore, this generator can also be installed in places in which an electric supply line is not installed, such as a mountain range and a desert, as a road sign or a guide marker. A temporary runway can be easily be prepared by installing as the guide light also at a place without an airport. When using this generator as a radar apparatus, it can be used also as a marker for guiding a movable body or the like automatically.

The invention concerning a twenty-six illustrative embodiment is a radiation device of electromagnetic waves using the dielectric lens comprising a dielectric lens, an electromagnetic wave generating body, and a position maintenance means. The dielectric lens is transparent to electromagnetic waves. The generating body which emits electromagnetic waves is provided in the focal length of this dielectric lens. The position maintenance means carries out position maintenance of the generating body at the focal length of the dielectric lens, and the position maintenance means comprises a maintenance mechanism that carries out position maintenance of the dielectric lens, and a cylindrical case which includes the dielectric lens. The maintenance mechanism carries out position maintenance of the dielectric lens so that the generating body may be located along the focal length of a dielectric lens. One end of the case has a maintenance mechanism, the other end of the case is either opened wide or is covered with a cover object formed by the member transparent to electromagnetic waves.

Since it constituted in this way, when using the generator of the invention of the twenty-sixth illustrative embodiment as a radar apparatus, it can be used as a marker for automatic guidance of a movable body or the like. It can be used also as a brake light for movable bodies, such as a car. If two or more generators are arranged in the case, a large-sized generator can be constructed. Since the dielectric lens is strongly fixed in the case, destruction, damage, mechanical modification, etc., do not occur.

The invention, in accordance with a twenty-seventh illustrative embodiment, is a radiation device of electromagnetic waves using the dielectric lens comprising a dielectric lens, a magnetic wave generating body, and a position maintenance means. The dielectric lens is transparent to electromagnetic waves. The generating body, which emits electromagnetic waves, is provided in the focal length of the dielectric lens. The position maintenance means carries out position maintenance of the generating body at the focal length of the dielectric lens, and the position maintenance means comprises a cylindrical container and a maintenance mechanism. The cylindrical container is formed by a member transparent to electromagnetic waves, and it has an inside diameter or an outer diameter equal to a focal length, and forms a hollow inside that can store two or more dielectric lenses, and this cylindrical container includes a dielectric lens. And the maintenance mechanism carries out position maintenance of a cylindrical container and each dielectric lens so that a cylindrical container may be located along the focal length of each dielectric lens. In the generating side of the generating body, either of a color filter, a liquid crystal, or both, are arranged.

Since it constituted in this way, the invention of the twenty-seventh illustrative embodiment has the same effects as that of the twenty-fifth illustrative embodiment. When the generating body of this generator is a light source, a generator that emits a predetermined color light is obtained.

The invention, in accordance with a twenty-eighth illustrative embodiment, is a radiation device of electromagnetic waves using the dielectric lens comprising a dielectric lens, an electromagnetic wave generating body, and a position maintenance means. The dielectric lens is transparent to electromagnetic waves. The generating body that emits electromagnetic waves is provided in the focal length of the dielectric lens. The position maintenance means carries out position maintenance of the generating body at the focal length of the dielectric lens, and the position maintenance means comprises a maintenance mechanism that carries out position maintenance of the dielectric lens, and a cylindrical case that includes a dielectric lens. The maintenance mechanism carries out position maintenance of the dielectric lens so that the generating body may be located along the focal length of the dielectric lens. One end of the case has a maintenance mechanism, the other end of the case is opened wide or the other end of the case is covered with a cover object formed by a member transparent to electromagnetic waves. In the generating side of the generating body, either a color filter, or liquid crystal, or both, are arranged.

Since it constituted in this way, the invention of the twenty-eighth illustrative embodiment has the same effects as that of the twenty-sixth illustrative embodiment. When the generating body of the generator is a light source, a generator that emits discretionary color light is obtained.

In the invention of twenty-fifth illustrative embodiment and the twenty-eighth illustrative embodiment, the invention of a twenty-ninth illustrative embodiment is a generator using the dielectric lens which has allocated a solar cell used as a power supply, when the liquid crystal has been arranged to the generating side of a generating body.

Since it constituted in this way, the invention of the twenty-ninth illustrative embodiment has the same effects as that of twenty-fifth illustrative embodiment and the twenty-eighth illustrative embodiment. Since electric power is supplied from a solar cell, the power supply for the liquid crystals of this generator does not need a special power supply, but once it is installed, it can be semi-perpetually used.

In the invention of the twenty-fifth illustrative embodiment and the twenty-sixth illustrative embodiment, the invention of a thirtieth illustrative embodiment is a generator using the dielectric lens, this generator arranges a shade cap for a position maintenance means, and the shade cap intercepts the sun rays irradiated by the dielectric lens.

Since it constituted in this way, the invention of the thirtieth illustrative embodiment has the same effects as twenty-fifth illustrative embodiment and the twenty-sixth illustrative embodiment. Since the sun rays irradiated by the dielectric lens with a shade cap are covered, this generator can avoid convergence of the sun rays by the dielectric lens on the surface of the position maintenance means arranged at the focal length of the dielectric lens. Therefore, since the position maintenance means is not heated, the generator is safe.

In the invention of the twenty-fifth illustrative embodiment and the twenty-sixth illustrative embodiment, the invention concerning a thirty-first embodiment is a generator using the dielectric lens, for the position maintenance means of this generator, light scattering material is provided instead of a shade cap, this light scattering material is formed with material which has light scattering characteristics.

Since it constituted in this way, the invention of the thirty-first illustrative embodiment has the same effects as that of the twenty-fifth illustrative embodiment and the twenty-sixth illustrative embodiment. Since sun rays are scattered by light scattering material, convergence of the sun rays to the focus by a dielectric lens is avoidable. Therefore, since the position maintenance means that carries out position maintenance of the generating body at the focal length of the dielectric lens is not heated, the generator is safe.

The invention, in accordance with a thirty-second illustrative embodiment, is a radiation device of electromagnetic waves using the dielectric lens comprising a dielectric lens, an electromagnetic wave generating body, and a position maintenance means. The dielectric lens is transparent to electromagnetic waves. The generating body that emits electromagnetic waves is provided in the focal length of the dielectric lens. The position maintenance means carries out position maintenance of the generating body at the focal length of the dielectric lens, and the position maintenance means comprises a maintenance mechanism that carries out position maintenance of the dielectric lens, and a cylindrical case that includes the dielectric lens. The maintenance mechanism carries out position maintenance of the dielectric lens so that the generating body may be located along the focal length of a dielectric lens. One end of the case has a maintenance mechanism, the other end of the case is opened wide or the other end of the case is covered with a cover object formed by the member transparent to electromagnetic waves. A window is provided in the position maintenance means, and in this window, either a color filter, or a liquid crystal, or both are arranged.

Since it constituted in this way, the invention of the thirty-second illustrative embodiment has the same effects as that of the twenty-sixth illustrative embodiment. A generator of discretionary colors is obtained by discretionarily choosing the color of the color filter arranged at the window of the generator.

The invention, in accordance with a thirty-third illustrative embodiment, is a traffic signal using the dielectric lens comprising a dielectric lens, an electromagnetic wave reflecting body, and a position maintenance means. The dielectric lens is transparent to electromagnetic waves. The electromagnetic wave reflecting body is provided at the focal length of the dielectric lens.

The position maintenance means carries out position maintenance of the reflecting body at the focal length of the dielectric lens. In the reflective surface of this reflecting body, a color filter of three kinds of colors is arranged, respectively. A rolling mechanism is arranged for a position maintenance means, and this rolling mechanism rotates three reflecting bodies by setting an axis of rotation at a perpendicular direction. A solar cell that supplies a power is arranged in this rolling mechanism.

Since it is constituted in this way, a power supply is perpetually supplied to the traffic signal of the invention of the thirty-third illustrative embodiment from sun rays. Since the usual power supply is not needed, this traffic signal can be used semi-perpetually as a traffic signal, once it is installed. Therefore, this traffic signal can be installed in places such as inside of a mountain, and in a desert. An temporary traffic signal and a temporary runway can be easily prepared by installing this traffic signal also at a place without a road or an airport. When operating vehicles automatically with a radar installation carried in vehicles, this traffic signal can be used as a reflector for operational control. Since a solar cell is used for this traffic signal, it does not need supply of electric power from a general power supply, and can be semi-perpetually operated as a traffic signal. Therefore, once it is installed as a traffic signal, subsequently the cost of a keeping a traffic signal will become eliminated and a very cheap traffic signal will be obtained.

The invention concerning a thirty-fourth illustrative embodiment is a traffic signal using the dielectric lens comprising a dielectric lens, an electromagnetic wave reflecting body, and a position maintenance means. The dielectric lens is transparent to electromagnetic waves. The electromagnetic wave reflecting body is provided in the focal length of the dielectric lens. The position maintenance means carries out position maintenance of the reflecting body at the focal length of the dielectric lens. In the reflective surface of this reflecting body, a color filter of three kinds of colors is arranged. The rolling mechanism is arranged with regard to the position maintenance means, and this rolling mechanism rotates three reflecting bodies along an axis of rotation having a perpendicular direction. The solar cell that supplies a power is arranged in this rolling mechanism. A reflecting body that has a slit, or a reflecting body that has metal pieces arranged separated from one another is used for the reflecting body.

Since it constituted in this way, the invention of the thirty-fourth illustrative embodiment has the same effects as the invention of the thirty-third illustrative embodiment. The distance from a traffic signal can also be measured with a radar installation carried in vehicles.

The invention, in accordance with a thirty-fifth illustrative embodiment, is a traffic signal using the dielectric lens comprising a dielectric lens, an electromagnetic wave reflecting body, and a position maintenance means. The dielectric lens is transparent to electromagnetic waves. The electromagnetic wave reflecting body is provided in the focal length of the dielectric lens.

The position maintenance means carries out position maintenance of the reflecting body at the focal length of the dielectric lens. In the reflective surface of the reflecting body, a color filter of three kinds of colors is arranged. A rolling mechanism is provided as a position maintenance means, this rolling mechanism rotates three reflecting bodies by setting the axis of rotation in a perpendicular direction. A solar cell which supplies a power supply is arranged with regard to this rolling mechanism. This traffic signal provides a shade cap for a position maintenance means, and this shade cap intercepts the sun rays irradiated by the dielectric lens.

Since it is constituted in this way, the invention of the thirty-fifth illustrative embodiment has the same effects as the invention according to the thirty-third illustrative embodiment. Since the sun rays irradiated by the dielectric lens with a shade cap are covered, this traffic signal can avoid convergence of the electromagnetic waves to the focus of the dielectric lens. Therefore, it is safe, without heating the traffic signal.

The invention concerning a thirty-sixth illustrative embodiment is a traffic signal using the dielectric lens comprising a dielectric lens, an electromagnetic wave reflecting body, and a position maintenance means. The dielectric lens is transparent to electromagnetic waves. An electromagnetic wave reflecting body is provided at the focal length of the dielectric lens.

The position maintenance means carries out position maintenance of the reflecting body at the focal length of the dielectric lens. In the reflective surface of the reflecting body, a color filter of three kinds of colors is arranged. A rolling mechanism is arranged as a position maintenance means, and this rolling mechanism rotates three reflecting bodies by setting an axis of rotation in a perpendicular direction. A solar cell that supplies a power is arranged in this rolling mechanism. A window is provided in the position maintenance means and either a color filter, or a liquid crystal, or both are arranged in this window.

Since it constituted in this way, the invention of the thirty-sixth illustrative embodiment has the same effects as the invention according to the thirty-third illustrative embodiment. The traffic signal having not only the colors of a traffic signal for road traffic, but also any discretionary colors, is obtained by choosing, as desired, the color of the color filter arranged at the window of this traffic signal.

BRIEF DESCRIPTION OF THE DRAWINGS

[Drawing 1]

[Drawing 2]

Figure 2:
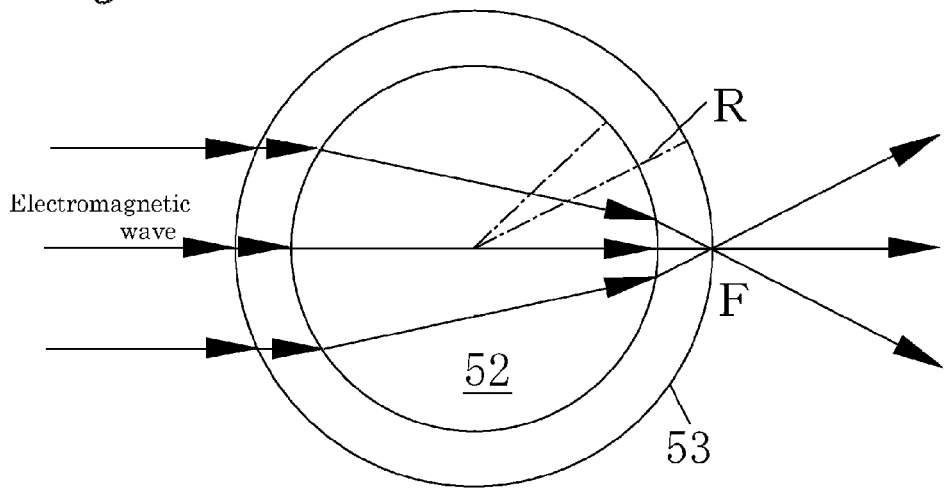

FIG. 2 is an explanatory diagram showing the 1st embodiment of the present invention and showing the relation of the position of dielectric lens 52 and dielectric shell 53.

[Drawing 3]

Figure 3:
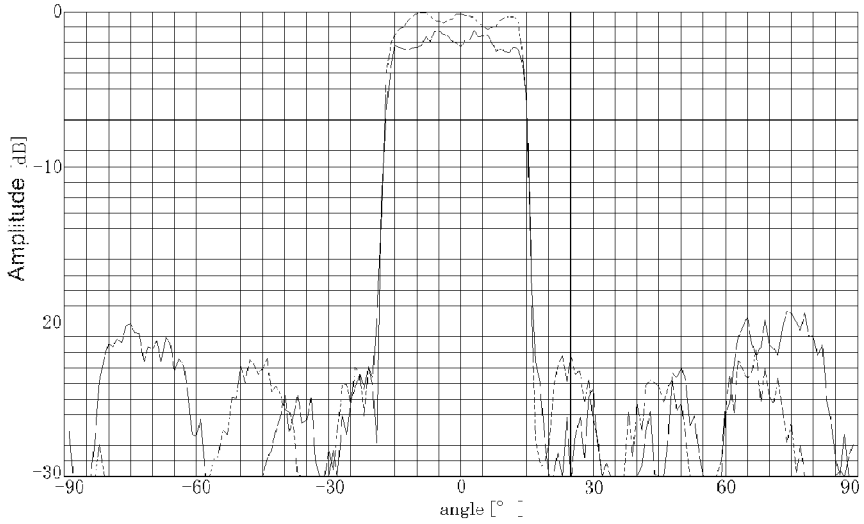

FIG. 3 shows the 1st embodiment of the present invention, as a dielectric member of dielectric shell 53, when acrylic resin is used, showing a reflective characteristic figure for observing the influence of dielectric shell 53.

[Drawing 4]

Figure 4:
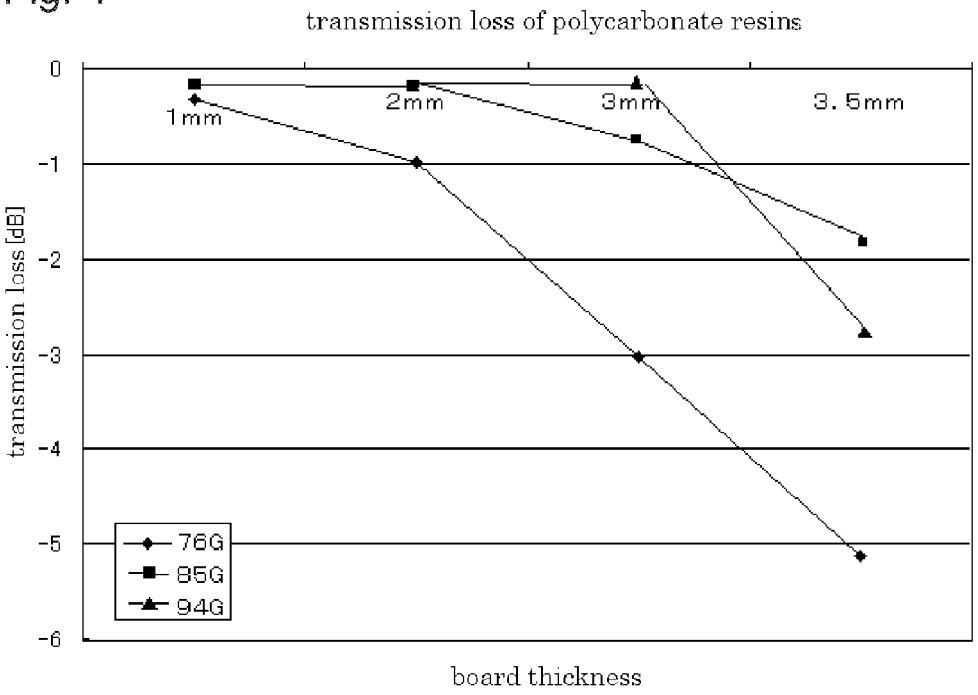

FIG. 4 shows the 1st embodiment of the present invention, as a dielectric member, when polycarbonate resin is used, showing the damping characteristic of electromagnetic waves with dielectric shell 53.

[Drawing 5]

Figure 5:
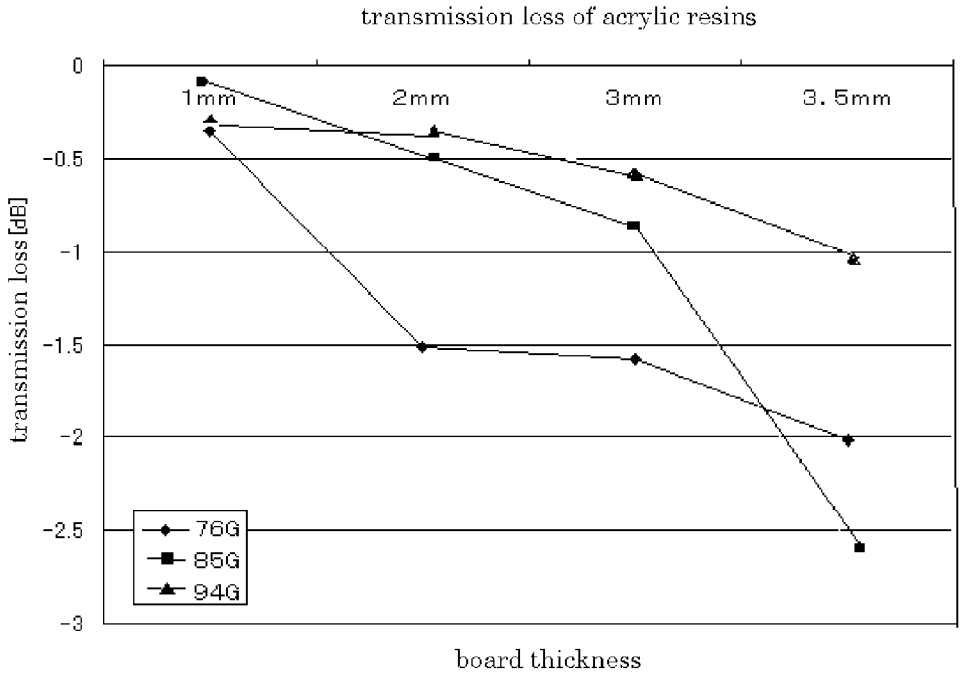

FIG. 5 shows the 1st embodiment of the present invention, as a dielectric member, when acrylic resin is used, showing the damping characteristic of electromagnetic waves with dielectric shell 53.

[Drawing 6]

Figure 6:
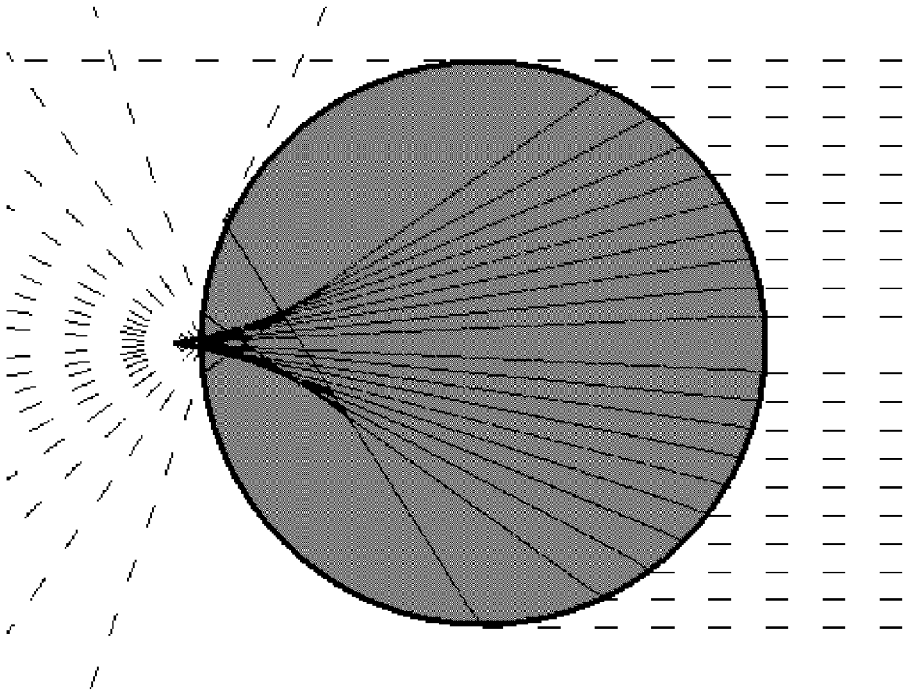

FIG. 6 shows experimental results of the 1st embodiment of this invention, where the dielectric loss of a dielectric member is small, the dielectric member is transparent to electromagnetic waves, and where the specific inductive capacity of the dielectric member is 3.5.

[Drawing 7]

Figure 7:
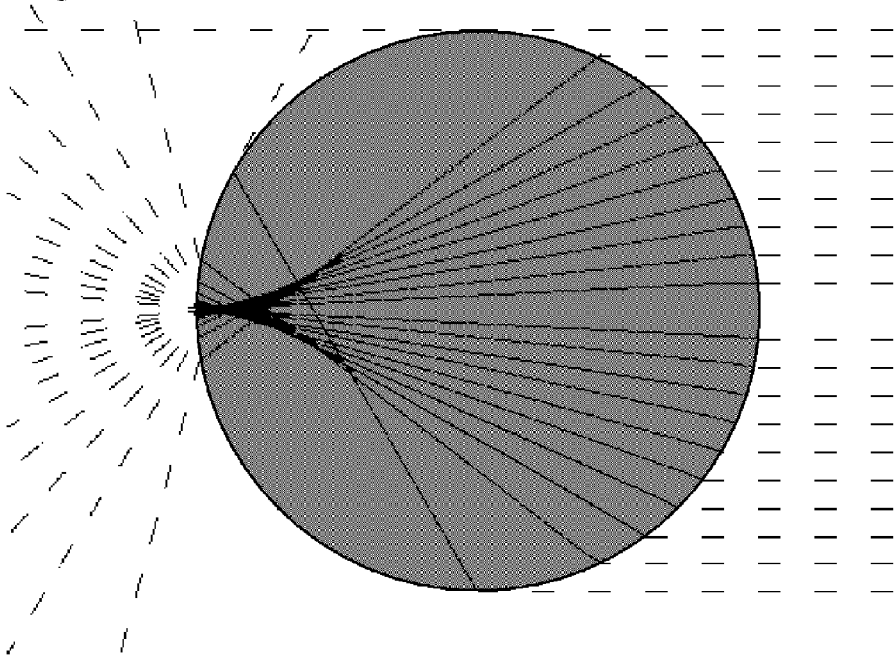

FIG. 7 shows experimental results of the 1st embodiment of this invention, where the dielectric loss of the dielectric member is small, the dielectric member is transparent to electromagnetic waves, and where the specific inductive capacity of the dielectric member is 4.0.

[Drawing 8]

Figure 8:
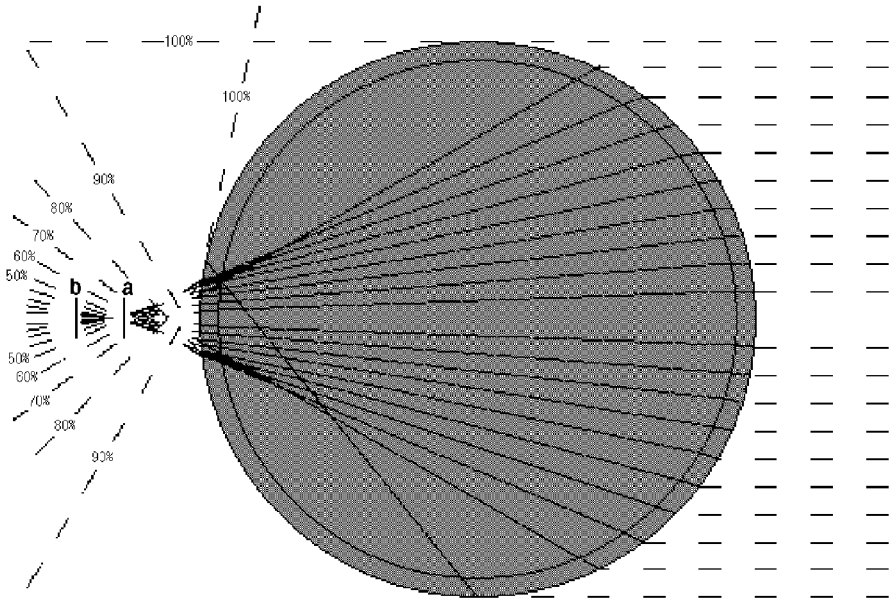

FIG. 8 shows an experimental result of the 2nd embodiment of this invention shows the result obtained by the optical ray tracing method about one section of the dielectric lens.

[Drawing 9]

Figure 9:
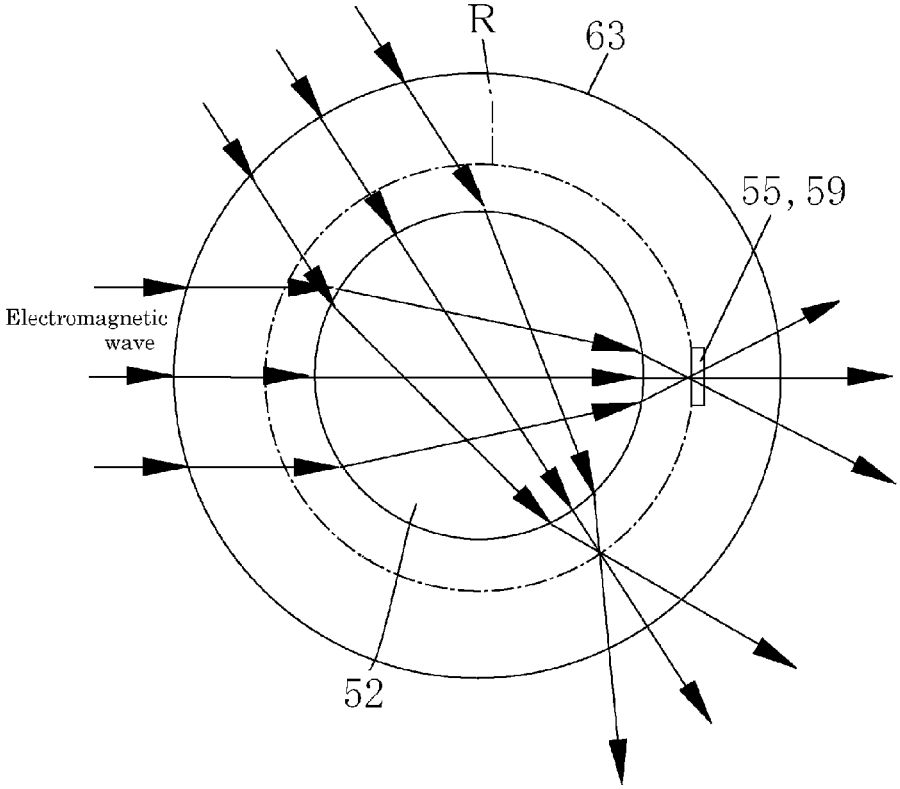

FIG. 9 shows the 2nd embodiment of this invention, and is an explanatory diagram showing the relation of positions, such as dielectric lens 52, dielectric shell 63, and reflecting body.

[Drawing 10]

Figure 10:
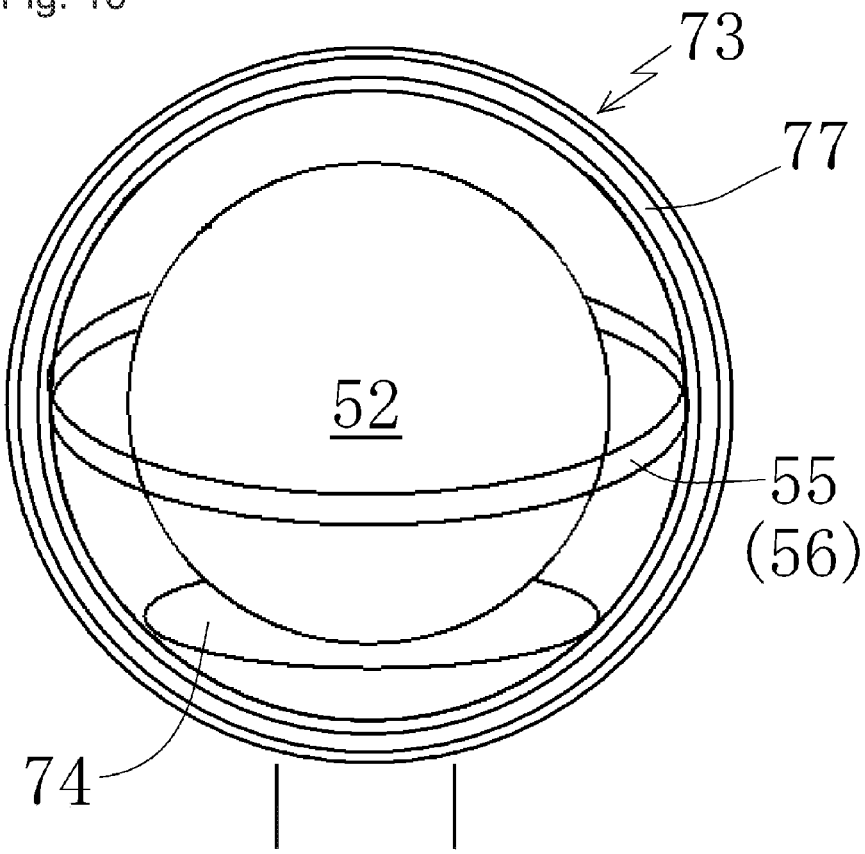

FIG. 10 is an exemplary diagram showing the 3rd embodiment of this invention.

[Drawing 11]

Figure 11:
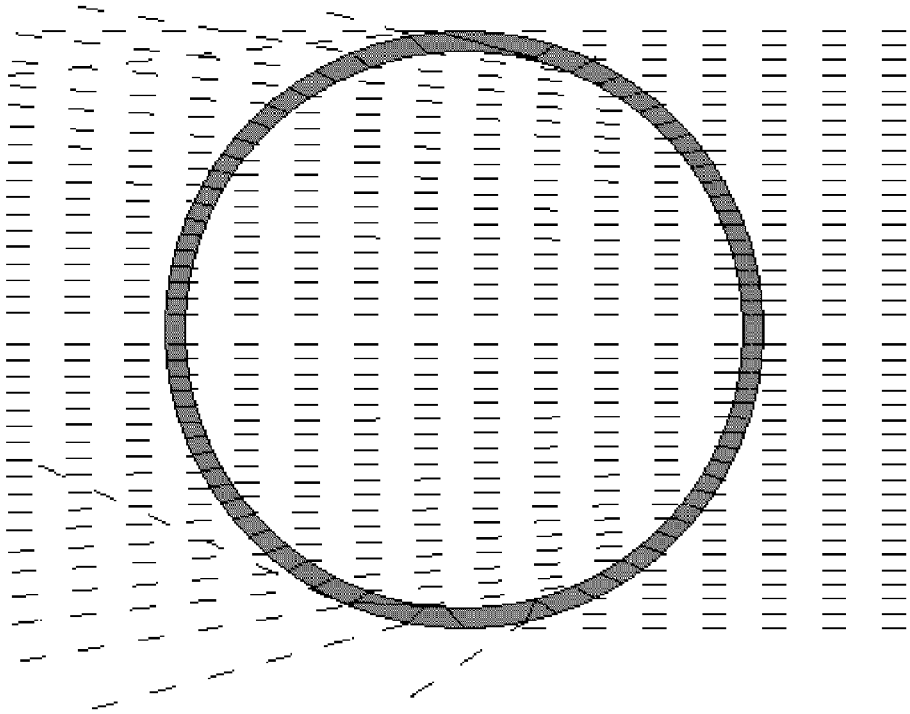

FIG. 11 shows the 3rd embodiment of this invention, and is an optical path inside the dielectric shell.

[Drawing 12]

Figure 12:
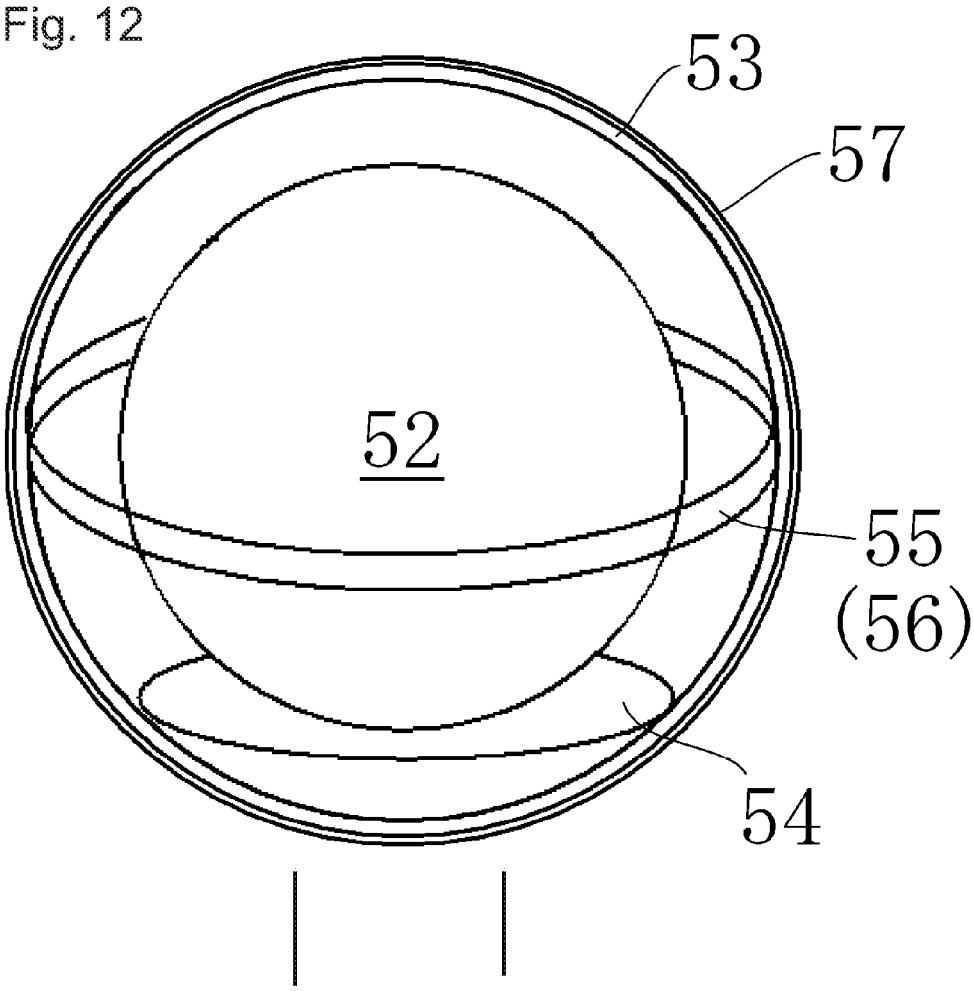

FIG. 12 is a exemplary diagram showing the 4th embodiment of this invention.

[Drawing 13]

Figure 13:
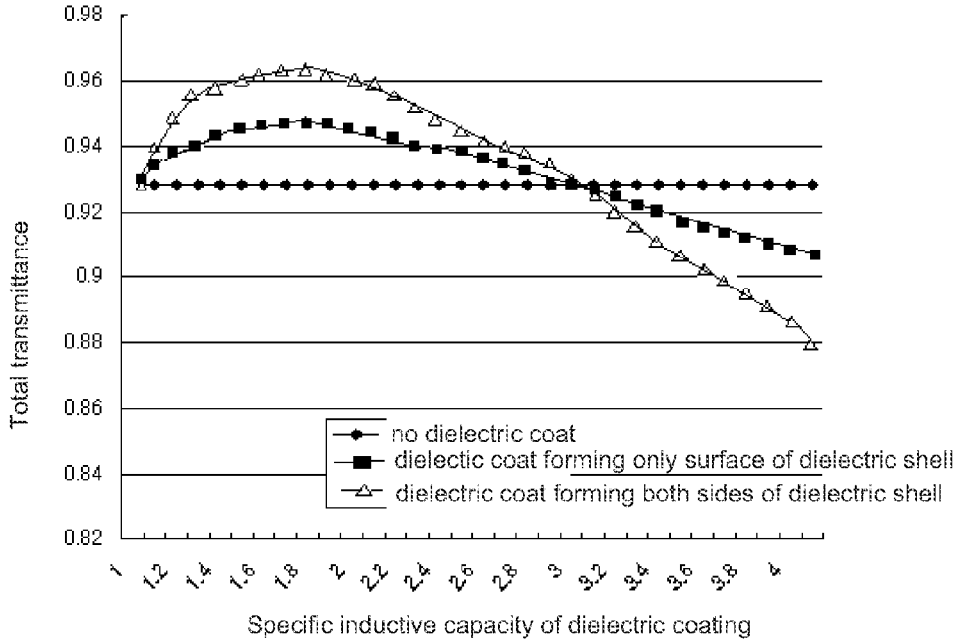

FIG. 13 shows the 4th embodiment of this invention, and is a figure showing the relation between specific inductive capacity and transmissivity of dielectric coating 57.

[Drawing 14]

Figure 14:
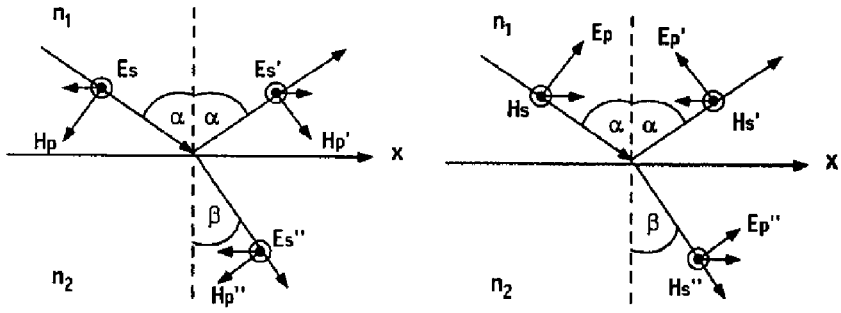

FIG. 14 is an explanatory diagram of light entering into a medium.

[Drawing 15]

Figure 15:
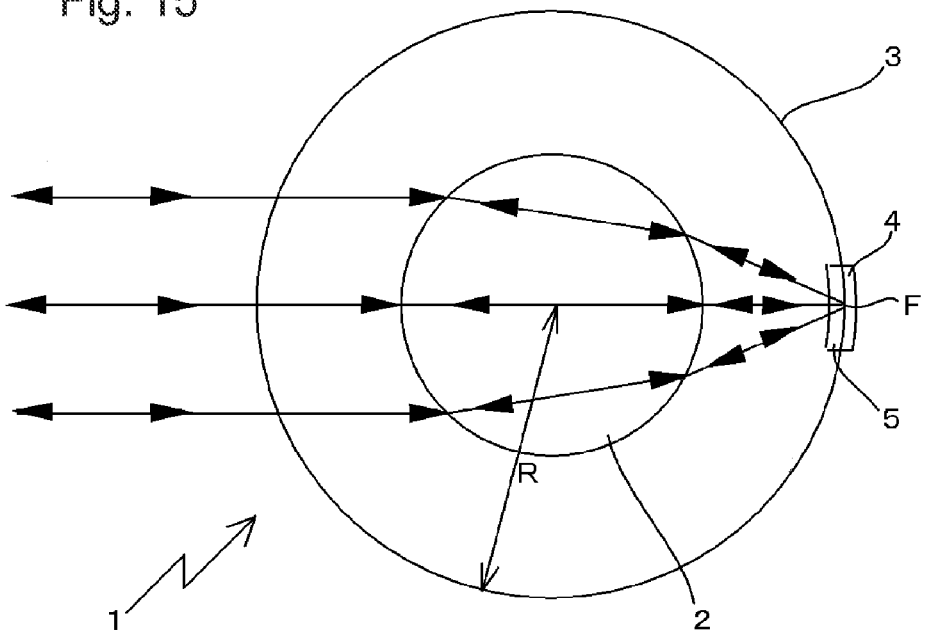

FIG. 15 shows the 5th embodiment of this invention, and is an exemplary diagram of the reflector using a dielectric lens device.

[Drawing 16]

Figure 16:
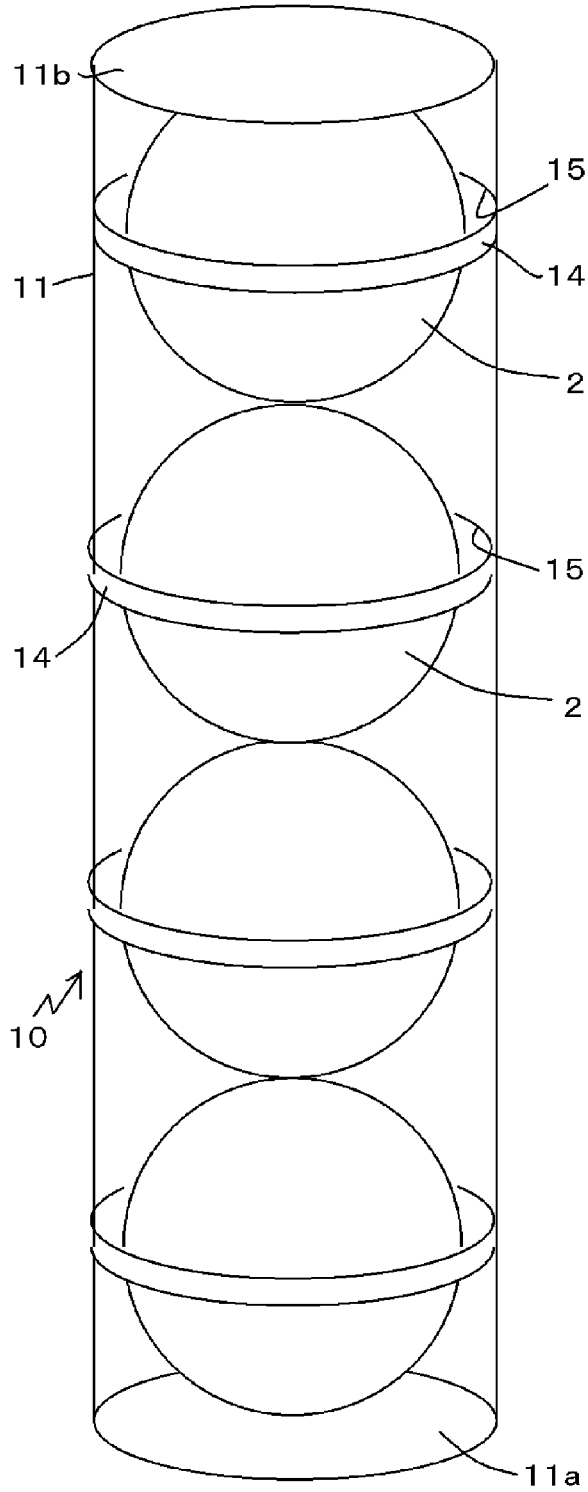

FIG. 16 shows the 6th embodiment of this invention, and is an exemplary diagram of a long bar reflector with cylindrical shape using a dielectric lens device.

[Drawing 17]

Figure 17:
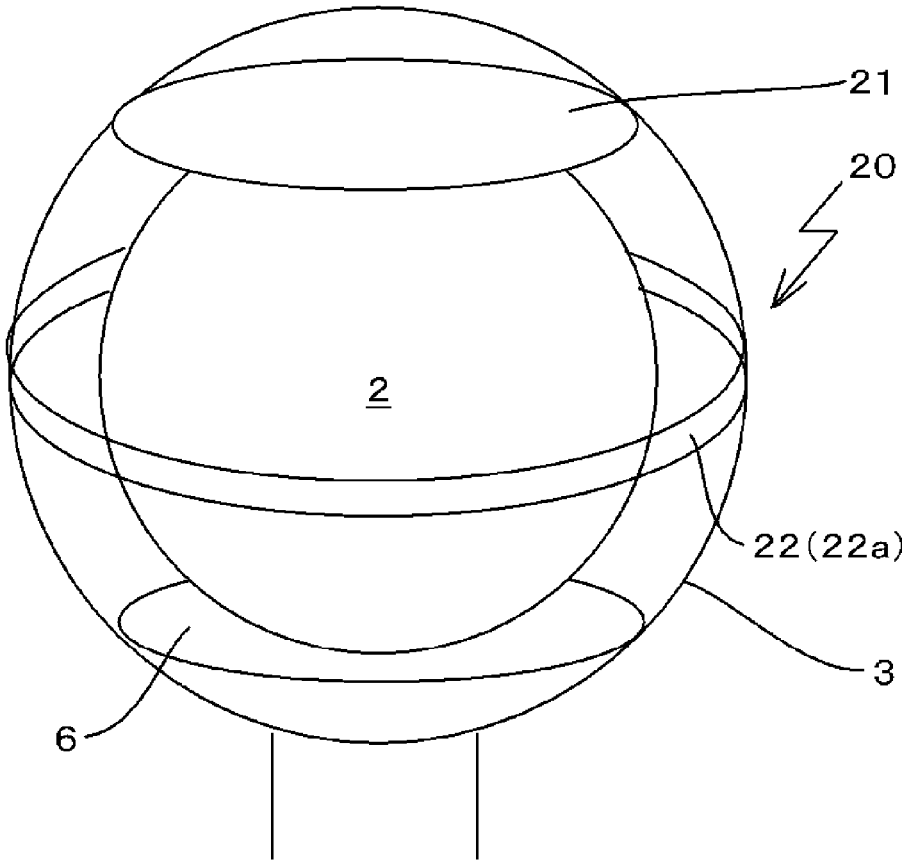

FIG. 17 shows the 7th embodiment of this invention, and is an exemplary diagram of a reflector and a generator arranged with a solar cell for the dielectric lens device.

[Drawing 18]

Figure 18:
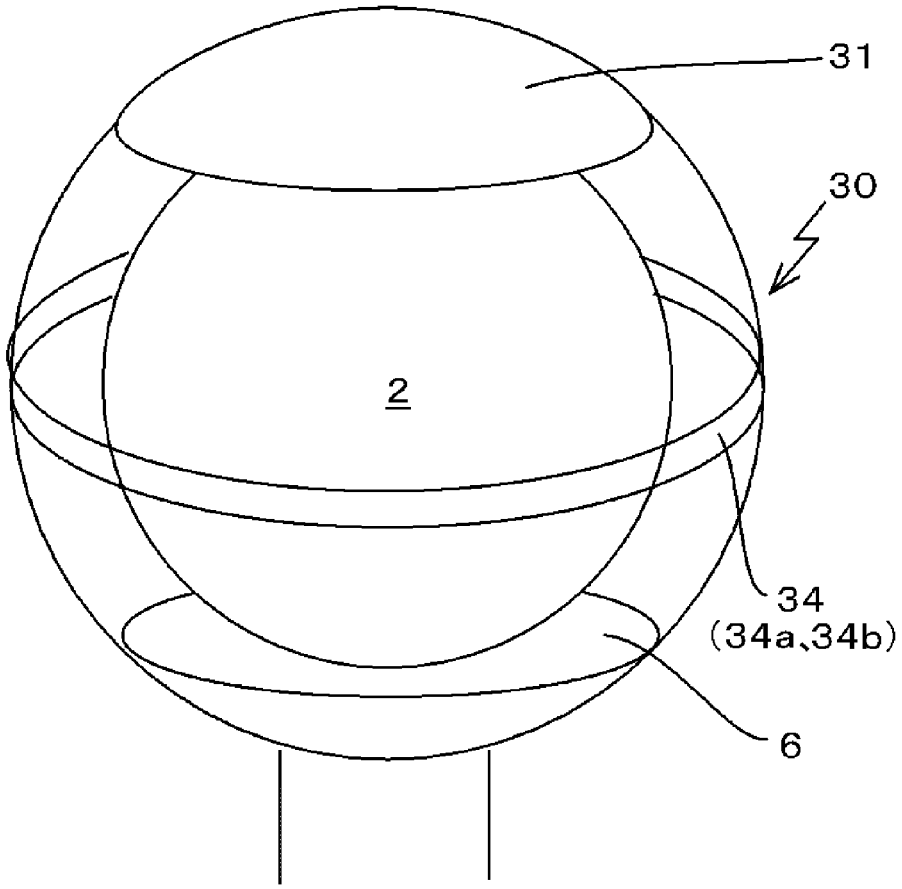

FIG. 18 shows the 8th and 9th embodiments of this invention, and is an exemplary diagram of a reflector providing a shade cap in the dielectric shell.

[Drawing 19]

Figure 19:
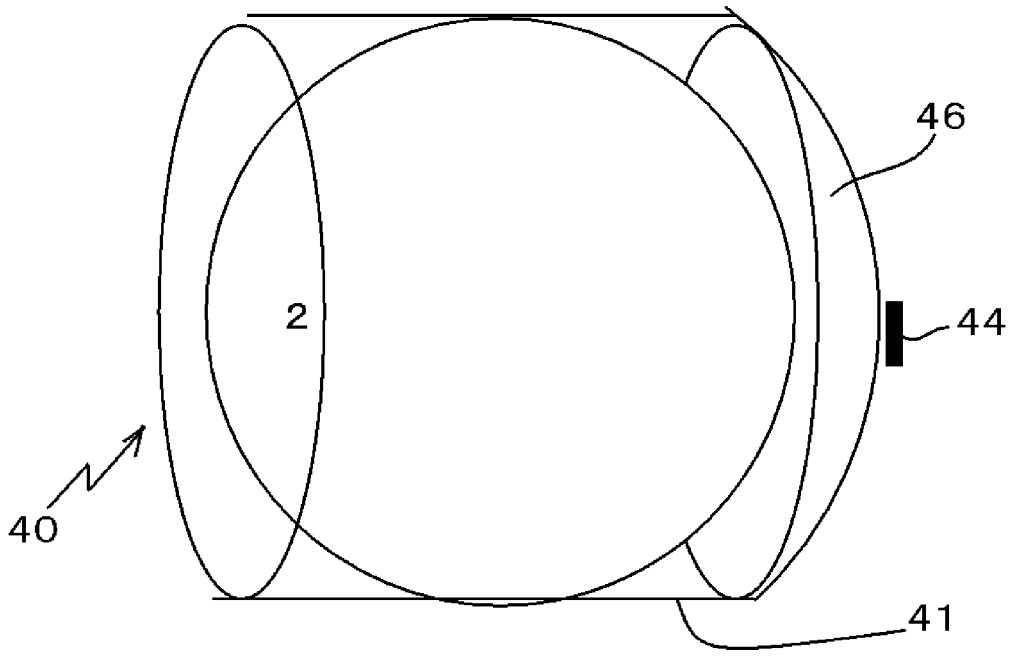

FIG. 19 shows the 10th embodiment of this invention, it is an exemplary diagram of a reflector for storing the dielectric lens device in the case.

[Drawing 20]

Figure 20:
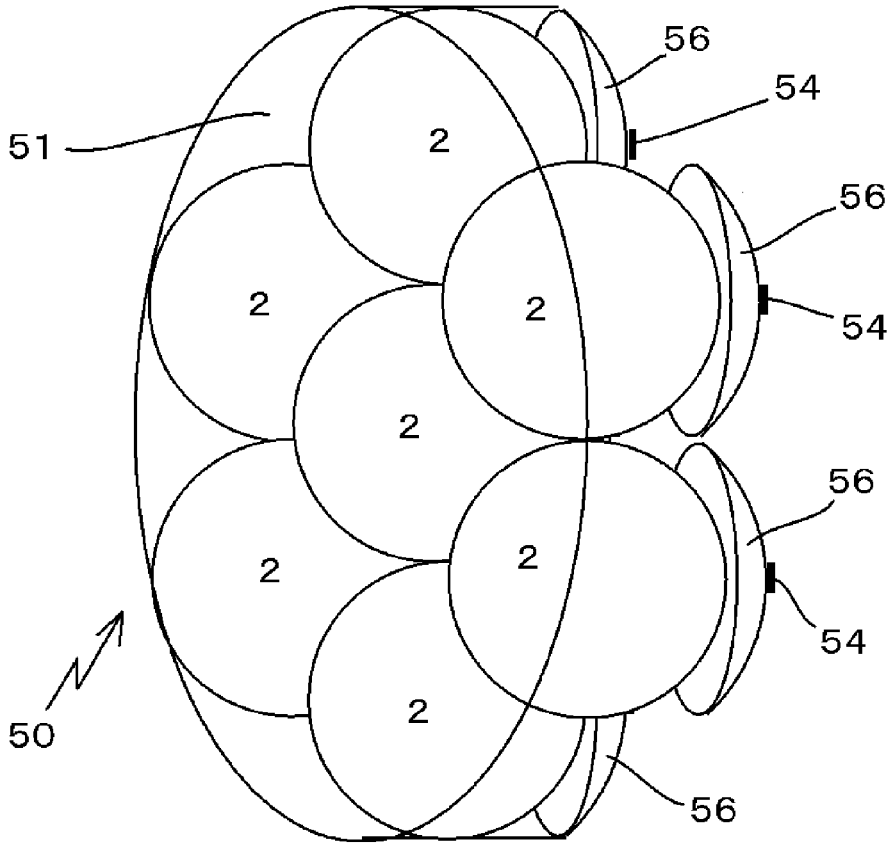

FIG. 20 shows the 10th embodiment of this invention, it is an exemplary diagram of the reflector for storing the dielectric lens device in the large-scale case.

[Drawing 21]

Figure 21:
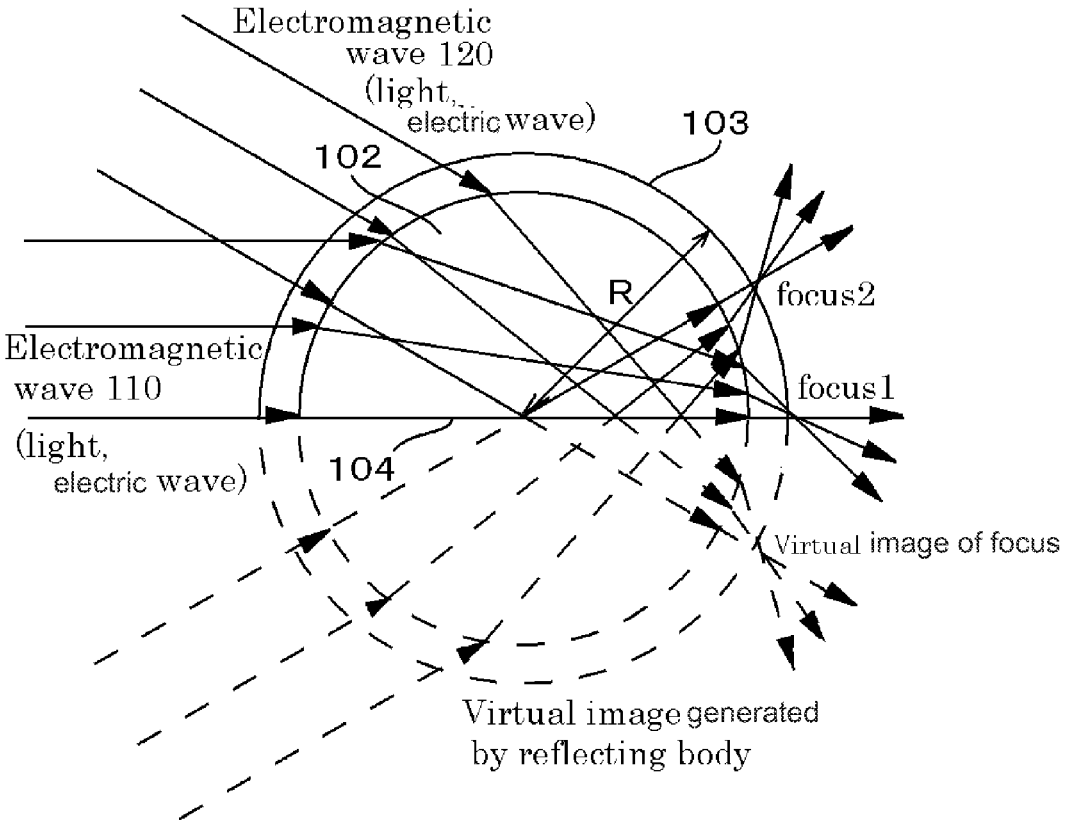

FIG. 21 is a figure showing principles when using a hemispherical shape dielectric lens.

[Drawing 22]

Figure 22:
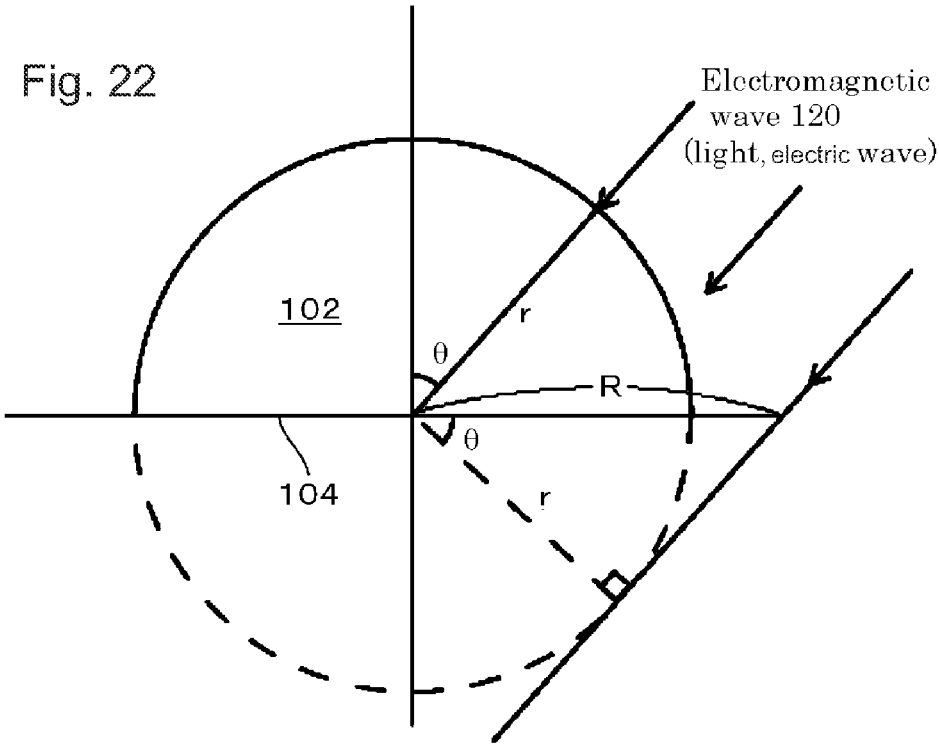

FIG. 22 is a figure showing principles when using a hemispherical shape dielectric lens.

[Drawing 23]

Figure 23:
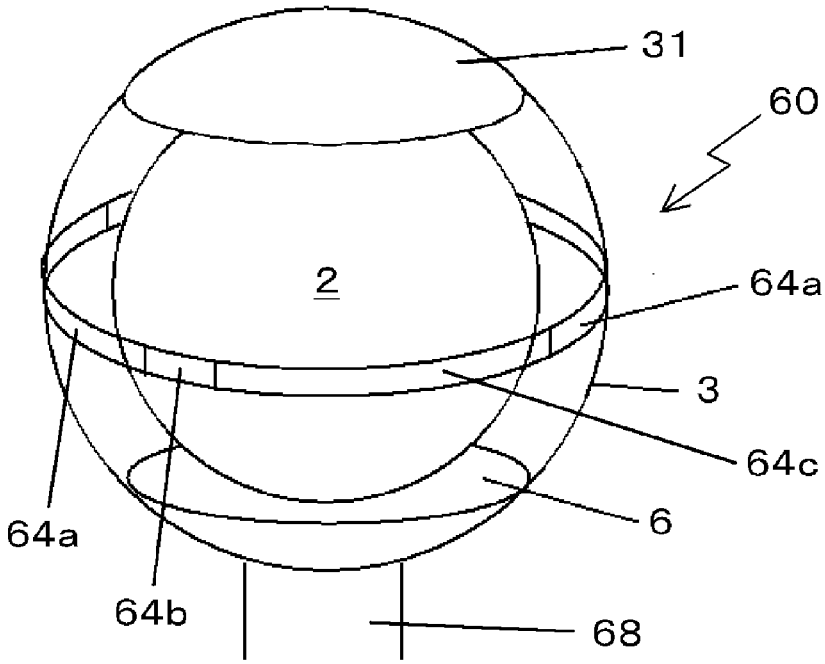

FIG. 23 shows the 11th embodiment of this invention, it is an exemplary diagram of reflector 110 which has reflecting bodies 115*a*-115*c* which has, attached to the color filter, three kinds of colors as a reflecting body.

[Drawing 24]

Figure 24:
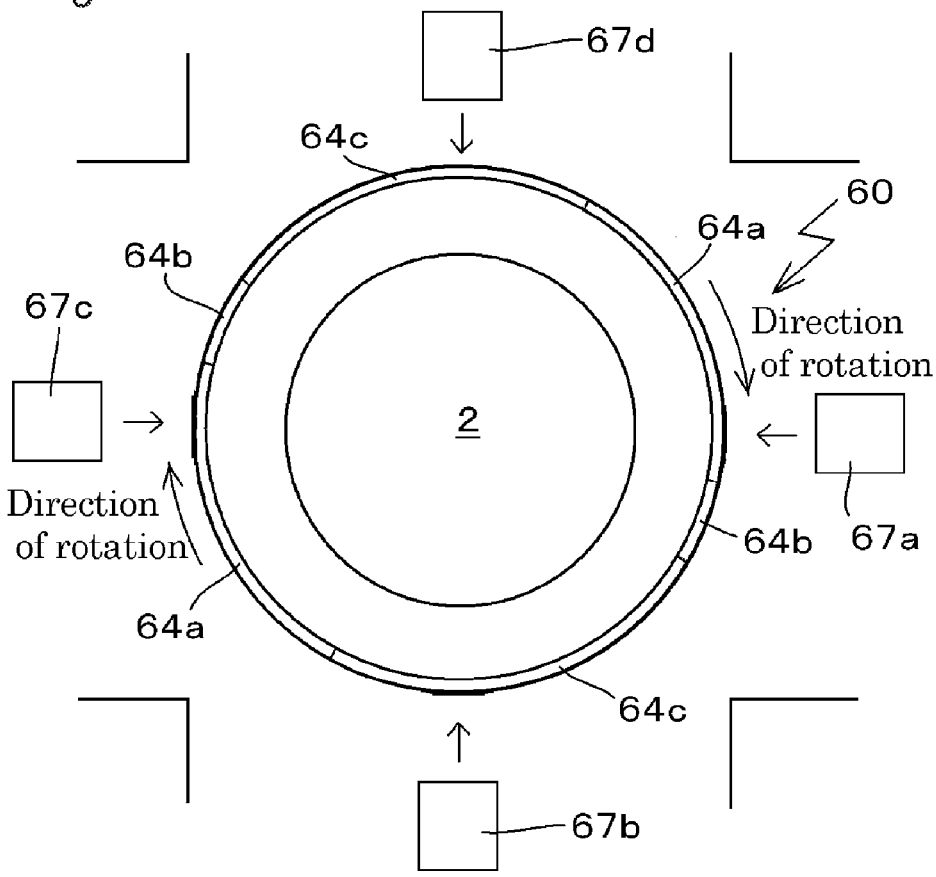

FIG. 24 shows the 11th embodiment of this invention, and is a principle figure when the traffic signal using reflector 110 is arranged and used for 4 angles.

[Drawing 25]

Figure 25:
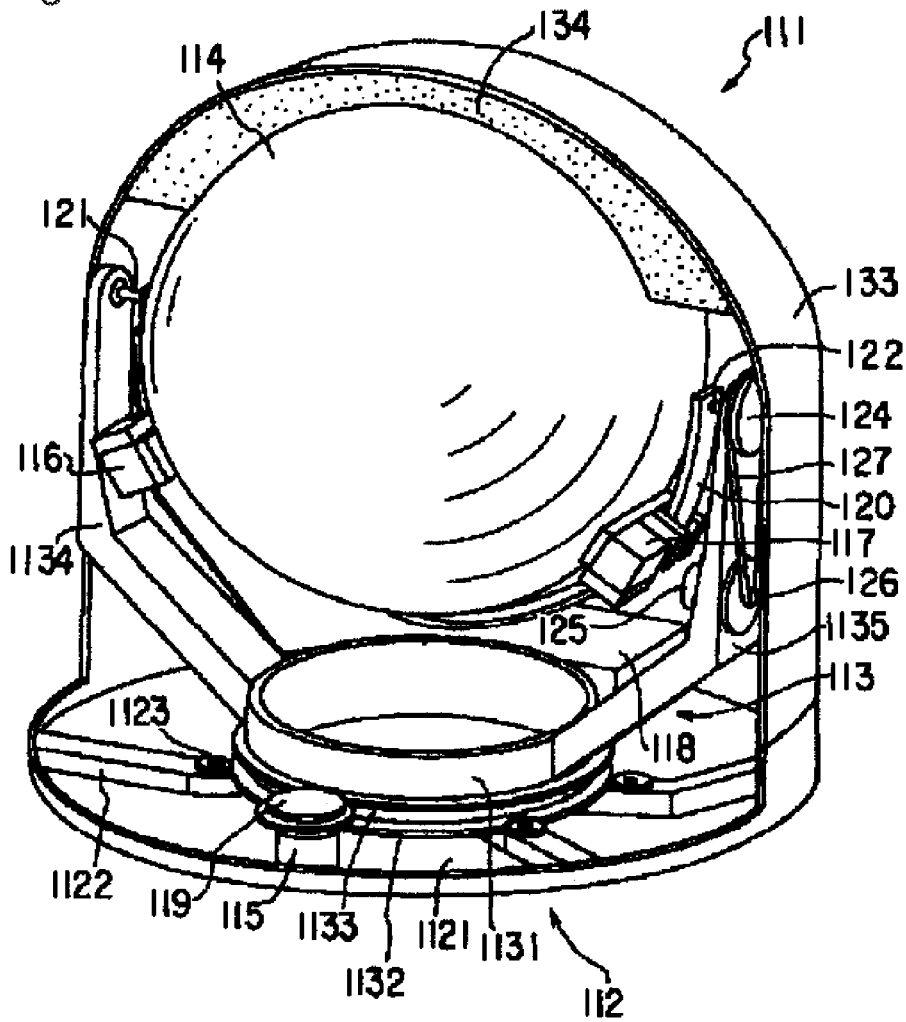

FIG. 25 is a perspective view showing a conventional example.

[Description of Notations]

| | |
|---|---|
| 1, 10, 20, 30, 40, 60, 100 | Device that reflects electromagnetic waves (reflector) |
| 2, 52, 102 | Dielectric lens |
| 3, 53, 63, 73, 103 | Dielectric shell |
| 4, 14, 34, 44, 54, 55, 64 | Reflecting body |
| 5, 15 | Color filter |
| 6, 46, 54, 56, 66, 74 | Maintenance mechanism |
| 11 | Cylindrical Container |
| 21 | Solar Cell |
| 22 | Electric Control Reflecting Body |
| 31 | Shade Cap |
| 34a | The reflecting body with a slit, or a generating body |
| 34b | The reflecting body or generating body formed with metal pieces |
| 50 | Device Using Dielectric Lens (Dielectric Lens Device) |
| 41, 51 | Case |
| 57 | Dielectric Coating |
| 59 | Electromagnetic Wave Receiving Section |
| 64 | Reflecting Body |
| 68 | Rolling Mechanism |
| 77 | Gap |
| 102 | Dielectric Lens of Hemispherical Form |
| 103 | Dielectric Shell of Hemispherical Form |

DETAILED DESCRIPTION OF THE INVENTION

Best Mode of Carrying Out the Invention

The invention relates to a device using a dielectric lens, comprising a dielectric lens, a dielectric shell, and a maintenance mechanism. In a preferred illustrative embodiment of the present invention, dielectric member that forms a dielectric lens has small dielectric loss, the dielectric member is transparent to electromagnetic waves, and the specific inductive capacity of the dielectric member is 3.5 or less. Preferably, the dielectric member that forms a dielectric shell has small dielectric loss, and the dielectric member is transparent to electromagnetic waves. The inside of the dielectric shell is formed hollow and the radius of one surface of this hollow inside has a radius equal to the focal length of a dielectric lens.

The maintenance mechanism carries out position maintenance of the dielectric shell and dielectric lens so that it may be in the state including that the dielectric lens is in the internal central part of the dielectric shell and the dielectric shell may be located in the position meeting the focal length. The device using the dielectric lens may have an electromagnetic wave reflecting body and an electromagnetic wave receiving section for receiving electromagnetic waves provided along the focal length of the dielectric lens. In the device using a dielectric lens, the thickness of the dielectric shell including the dielectric lens is formed with polycarbonate resin of 3 mm or less, or is formed with acrylic resin of 3 mm or less. A dielectric lens is formed with polystyrene resin transparent to electromagnetic waves.

A device (hereafter described as a reflector) reflects the electromagnetic waves using the dielectric lens, and comprises a dielectric lens, a reflecting body, and a position maintenance means. The dielectric lens is transparent to electromagnetic waves. The reflecting body is provided in the focal length of the dielectric lens.

The position maintenance means carries out position maintenance of the electromagnetic wave reflecting body at the focal length of the dielectric lens. The position maintenance means is related to a dielectric shell and a maintenance mechanism. The dielectric shell has an inside diameter or an outer diameter equal to a focal length, and forms a hollow inside that can store a dielectric lens with a member transparent to electromagnetic waves, and this dielectric shell includes a dielectric lens. The maintenance mechanism carries out position maintenance of the dielectric shell and the dielectric lens so that the dielectric shell may be located along the focal length of a dielectric lens. In the reflective surface of the reflecting body, either a color filter, or a liquid crystal, or both are arranged. The reflector may be provided with a solar cell for liquid crystals.

The reflector using the dielectric lens comprises a dielectric lens, an electromagnetic wave reflecting body, and a position maintenance means. The dielectric lens is transparent to electromagnetic waves. The electromagnetic reflecting body is provided in the focal length of the dielectric lens. The position maintenance means carries out position maintenance of the reflecting body at the focal length of the dielectric lens. And the position maintenance means comprises a cylindrical container and a maintenance mechanism. The cylindrical container is formed by a member transparent to electromagnetic waves, has the inside diameter or outer diameter of a dielectric lens equal to a focal length, and forms an inside hollow that can store two or more dielectric lenses. The cylindrical container includes a dielectric lens. A maintenance mechanism carries out position maintenance of a cylindrical container and each dielectric lens so that the cylindrical container may be located along the focal length of each dielectric lens.

A reflector using the dielectric lens is associated with a dielectric lens, an electromagnetic wave reflecting body, and a position maintenance means. The dielectric lens of this reflector is transparent to electromagnetic waves. The reflecting body is provided in the focal length of this dielectric lens. The position maintenance means carries out position maintenance of that reflecting body at the focal length of a dielectric lens. The electric control reflecting body that can control electromagnetic waves is provided in a reflecting body. The solar cell used as a power supply is allocated in an electric control reflecting body. The reflector using the dielectric lens may be arranged with a shade cap that intercepts the sun rays reflected by the dielectric lens for position maintenance means. A heating prevention type reflector may be formed by light scattering material instead of a shade cap.

A radiation device (it is hereafter described as a generator) of electromagnetic waves using the dielectric lens comprises a dielectric lens, an electromagnetic wave generating body, and a position maintenance means.

The dielectric lens of this generator is transparent to electromagnetic waves. The electromagnetic wave generating body, which emits electromagnetic waves, is provided in the focal length of the dielectric lens. The position maintenance means carries out position maintenance of the generating body at the focal length of a dielectric lens. And the position maintenance means comprises a cylindrical container and a maintenance mechanism. The cylindrical container is formed by a member transparent to electromagnetic waves, and it has an inside diameter or an outer diameter equal to a focal length, and forms an inside hollow that can store two or more dielectric lenses, and this cylindrical container includes a dielectric lens. A maintenance mechanism carries out position maintenance of the cylindrical container and each dielectric lens so that the cylindrical container may be located along the focal length of each dielectric lens.

The generator of electromagnetic waves using the dielectric lens is arranged with either a color filter, or a liquid crystal, or both on the generating side of a generating body in the generator.

The generator of electromagnetic waves using the dielectric lens is provided with a shade cap which intercepts sun rays to the dielectric lens that has a position maintenance means. The generator of electromagnetic waves using the dielectric lens is allocated with light scattering material instead of the shade cap.

A traffic signal using the dielectric lens comprises a dielectric lens, an electromagnetic wave reflecting body, and a position maintenance means. The dielectric lens is transparent to electromagnetic waves. The magnetic wave reflecting body is provided at the focal length of the dielectric lens. The position maintenance means carries out position maintenance of the reflecting body at the focal length of the dielectric lens. In the reflective surface of the reflecting body, a color filter of three kinds of colors is arranged, respectively. For a position maintenance means, a rolling mechanism is further provided. This rolling mechanism rotates three reflecting bodies by setting the axis of rotation in a perpendicular direction. A solar cell that supplies a power is arranged associated with this rolling mechanism.

Embodiment 1

The inventors propose various devices using the dielectric lens. The device using the dielectric lens can be used throughout the electromagnetic spectrum.

In particular, it can be used for the light wave band, not to mention the radio wave band. It has transparent omnidirectionality to electromagnetic waves. Subsequently, the inventors propose various devices regarding the applicable field of the device using these dielectric lenses. Hereafter, the 1st embodiment of this invention is explained in detail based on FIGS. 1-7. The shape of the dielectric lens is preferably spherical. However, invention is not limited to this shape. For example, the shape of the dielectric lens may be hemispherical.

In short, as long as the shape of the dielectric lens is a shape that can converge electromagnetic waves on a focal point, it may be that shape.

Figure 1:
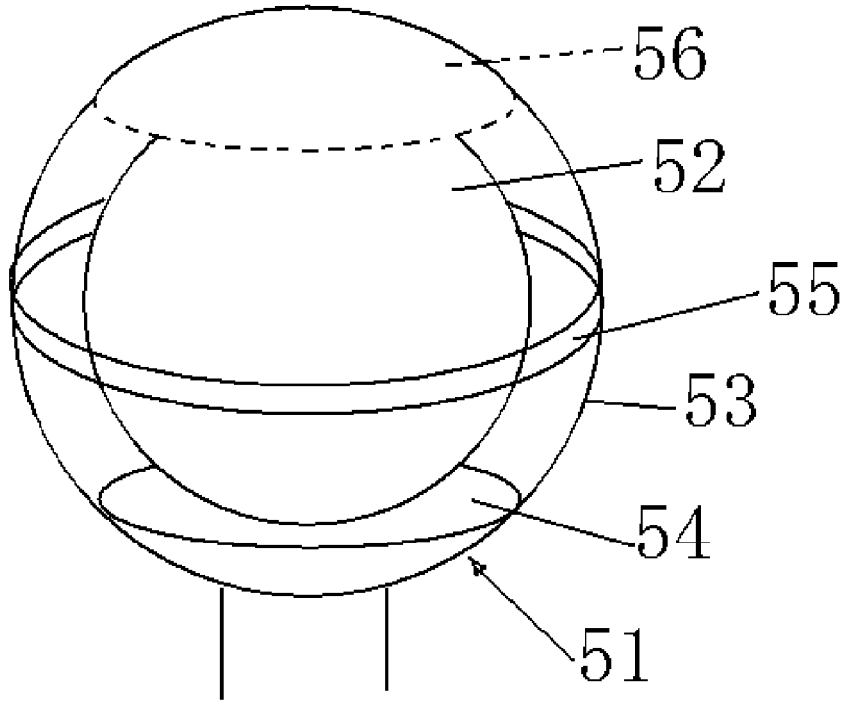
FIG. 1 is an exemplary diagram showing the 1st embodiment of the present invention, and shows the device using the dielectric lens provided with reflecting body 55.

FIGS. 1-7 show the 1st embodiment of this invention, and FIG. 1 is an exemplary diagram of the device using the dielectric lens that has reflecting body 55 provided in dielectric lens device 51. FIG. 2 is an explanatory diagram showing the relation of the position of dielectric lens 52 and dielectric shell 53. FIG. 3 is a reflective characteristic figure for observing the influence of dielectric shell 53, when polycarbonate resin is used as a dielectric member of dielectric shell 53. The ordinate axis shows an attenuation value (dB), and the horizontal axis shows the degree of incidence angle (degree) of electromagnetic waves. FIGS. 4-5 show the damping characteristic of electromagnetic waves with dielectric shell 53 by making frequency of the electromagnetic waves into a parameter. The ordinate axis shows a transmission loss (dB), and the horizontal axis shows the board thickness (mm) of the dielectric member. FIG. 4 shows a case where polycarbonate resin is used as the dielectric member. FIG. 5 shows a case where acrylic resin is used as the dielectric member. FIGS. 6-7 show the experimental result for testing a dielectric member available as a transparent dielectric member with small dielectric loss. FIG. 6 shows a case where the specific inductive capacity of the dielectric member is 3.5. FIG. 7 shows a case where the specific inductive capacity of the dielectric member is 4.0.

In FIGS. 1-2, dielectric lens device 51 of the 1st embodiment of the invention comprises dielectric lens 52, dielectric shell 53, and maintenance mechanism 54. Dielectric shell 53 contains dielectric lens 52, and maintenance mechanism 54 positions and fixes dielectric shell 53 and dielectric lens 52.

In this embodiment, dielectric lens 52 is formed in a spherical form as a transparent dielectric member with small dielectric loss using transparent polystyrene resin.

When electromagnetic waves (radio waves and light waves) pass the dielectric lens, they are refracted, and they converge on focus F. In this embodiment, since the whole is a transparent sphere, dielectric lens 52 has omnidirectionality not only to the radio wave band but also to the light wave band.

Here, in order to find out the dielectric member, which can be used as a dielectric lens, the inventors analyzed the effect of the difference in specific inductive capacity by the optical ray tracing method using two or more dielectric lenses formed by the dielectric member from which specific inductive capacity differs, respectively. The results of the analysis are shown in FIGS. 6-7. FIG. 6 shows the case where specific inductive capacity is 3.5, and FIG. 7 shows the case where specific inductive capacity is 4.0. As a result, when specific inductive capacity is 3.5, the focus is located in the dielectric lens surface as shown in FIG. 6. When specific inductive capacity is 4.0, the focus is located on the inside of the dielectric lens as shown in FIG. 7. Therefore, when specific inductive capacity was 3.5 or less, it became clear that it was available as a dielectric lens according to the present invention.

Dielectric shell 53 is formed in a spherical form which has space on the inside using a transparent dielectric member with small dielectric loss. The radius of the inner surface of a sphere of dielectric shell 53 or the outer surface of a sphere of dielectric shell 53, i.e., the radius of one surface of the sphere of dielectric shells 53, is equal to focal length R of dielectric lens 52. And dielectric lens 52 is arranged so that it is fixed to the internal central part of this dielectric shell 53 by maintenance mechanism 54. One surface of a sphere of dielectric shell 53 is positioned by maintenance mechanism 54 so that it may be located along focal length R of dielectric lens 52.

In the case of this embodiment, shown in FIG. 1, the maintenance mechanism 54 is a spherical form equal to the inside diameter of dielectric shell 53, and is formed in the shape where the spherical bottom end was cut. And the recess which holds the bottom end of dielectric lens 52 fixed is provided in the center section of the dissecting plane. The transparent dielectric member with small dielectric loss is used for maintenance mechanism 54. Without maintenance mechanism 54 being limited to this embodiment, the dielectric lens 52 is included in the internal central part of dielectric shell 53, and as one surface of a sphere, dielectric shell 53 is located along focal length R. If maintenance mechanism 54 is a structure that can carry out position maintenance of dielectric shell 53 and the dielectric lens 52, it may be another sort of structure.

55 is a reflecting body that reflects electromagnetic waves. Dielectric shell 53 is positioned at focal length R of dielectric lens 52. Reflecting body 55 is arranged and positioned at either the inner surface of the sphere of this dielectric shell 53, or the outer surface of the sphere. 58 is a shade cap. Since dielectric shell 53 is arranged at focal length R of dielectric lens 52, when dielectric lens device 51 is used with the light wave band, it converges light on the surface (focus F) of dielectric shell 53 with dielectric lens 52, and dielectric shell 53 is heated. Therefore, this shade cap 58 is for intercepting the sun rays from the upper part.

Electromagnetic wave receiving section 59 (refer to FIG. 9) receives the signal that converges on focus F of dielectric lens 52. This electromagnetic wave receiving section 59 may be provided in focal length R of dielectric lens 52 instead of reflecting body 55. In this case, a dielectric lens device having a receiving function is obtained.

In focal length R of dielectric lens 52, a reflecting body may be arranged with an electromagnetic wave receiving section. In this case, a dielectric lens device that has a reflective function and a receiving function is obtained.

As shown in FIG. 3, the inventors performed measurements for observing the influence on electromagnetic waves by dielectric shell 53 regarding dielectric lens apparatus 51 constructed in this way. However, acrylic resin was used as the dielectric member of dielectric shell 53. It was measured using millimeter wave electromagnetic waves.

In FIG. 3, the ordinate axis shows the attenuation value (dB) of the electromagnetic waves, and the horizontal axis shows the degree of incidence angle of the electromagnetic waves (degree). The continuous line in the data in case dielectric lens device 51 has dielectric shell 53, and the short dash line is data only in the case of dielectric lens 52. As a result, it became clear that the attenuation to the incidence angle of electromagnetic waves was not related to the existence of dielectric shell 53.

In order to find out the relation between the dielectric member optimal for use as dielectric shell 53, and the board thickness of the dielectric member, the inventors performed various kinds of measurements. As a dielectric member, two kinds of resin, polycarbonate resin and acrylic resin were adopted. Each sample (of thickness 1 mm, 2 mm, 3 mm, and 3.5 mm) was used for the board thickness of dielectric shell 53, respectively. For each sample, the transmission loss of the electromagnetic waves that enter into dielectric lens device 51 was measured. The varied parameter is the frequency of the electromagnetic waves. The result is shown in FIGS. 4-5, respectively.

Dielectric shell 53 was formed using polycarbonate resin as the dielectric member of dielectric shell 53. Transmission loss was measured in each case where the board thickness of each sample is 1 mm, 2 mm, 3 mm, and 3.5 mm, respectively. A varied parameter was the frequency of electromagnetic waves. The result is shown in FIG. 6.

In FIG. 4, the line "-●-●-●-" shows a result of a measurement when the frequency of electromagnetic waves is 76 GHz, the line "-■-■-■-" shows a result of a measurement when the frequency of electromagnetic waves is 85 GHz, and the line "-Δ-Δ-Δ-" shows the result of a measurement when the frequency of electromagnetic waves is 94 GHz, respectively.

When the result of a measurement shown in FIG. 4 is seen, the material thickness of dielectric shell 53 is up to 1 mm and 2 mm, the transmission loss of dielectric shell 53 was small for each frequency (76 GHz, 85 GHz, 94 GHz). Therefore, it became clear that polycarbonate resin was suitable as a dielectric member of dielectric shell 53. However, if the thickness of dielectric shell 53 is set to 2 mm or more when the frequency of electromagnetic waves is 76 GHz, transmission loss will increase rapidly. It was frequency higher than the frequency of a millimeter wave band, and when the board thickness of dielectric shell 53 was 3 mm or less, it became clear that polycarbonate resin could be enough used as a dielectric member of dielectric shell 53.

Subsequently, the inventors formed dielectric shell 53 like the above, using acrylic resin as a dielectric member of dielectric shell 53. Transmission loss was measured where the material thickness of each sample is 1 mm, 2 mm, 3 mm, and 3.5 mm. The result is shown in FIG. 5. In FIG. 5, the line "-●-●-●-" shows a result of a measurement in case the frequency of electromagnetic waves is 76 GHz, the line "-■-■-■-" shows a result of a measurement in case the frequency of electromagnetic waves is 85 GHz, and the line "-Δ-Δ-Δ-" shows the result of a measurement in case the frequency of electromagnetic waves is 94 GHz, respectively.

When the result of a measurement shown in FIG. 5 is seen with the board thickness of dielectric shell 53 at 1 mm, the transmission loss of dielectric shell 53 is low in each frequency (76 GHz, 85 GHz, 94 GHz). Therefore, it became clear that acrylic resin was suitable as a dielectric member of dielectric shell 53. However, if the material thickness of dielectric shell 53 exceeds 1 mm, when the frequency of electromagnetic waves is 76 GHz, transmission loss will increase rapidly. With frequency higher than the frequency of the millimeter wave band, and when the thickness of dielectric shell 53 was 3 mm or less, it became clear that acrylic resin was sufficient to use as a dielectric member of dielectric shell 53.

Embodiment 2

In the 2nd embodiment of this invention, the problem in the case of using dielectric lens device 51 with the light wave band is solved. This is explained using FIGS. 8-9. FIGS. 8-9 show the experimental result using the optical ray tracing method about one section of the dielectric lens. The same name and the same reference numerals are associated with the same parts as the 1st embodiment, so the corresponding explanation is omitted.

Since dielectric shell 53 has been arranged in focal length R of dielectric lens 52 in the case of Embodiment 1, when dielectric lens device 51 is used in the light wave band, it converges light on the surface of dielectric shell 53 with dielectric lens 52, and there is a problem that dielectric shell 53 is heated. When there is little receiving energy of light, it seldom becomes a problem, but it becomes a problem when the receiving energy is large.

The polarization of actual sun rays is quite complicated. Thus, as shown in FIG. 8, the inventors conducted an experiment by the optical ray tracing method on one section of the dielectric lens for the purpose of simplifying the polarization of sun rays. The result of the analysis is shown in FIG. 8. Under the present circumstances, in order to simplify the analysis, the refractive index of the dielectric shell was set to about 1.6, and internal loss was set to 0. With Snell's law, as shown in FIG. 8, light (electromagnetic waves) is refracted in a border plane. If an optical (radio wave) path is pursued, unlike the usual optical lens, the aberration of the focus will become large.

Then, if aperture plane effectiveness sets the focal position to a (distance at which 50% of incidence energies accumulates for a specific area) which is about 50% as shown in FIG. 8, the incidence angle in this focal position a is 70%*70%. Then, in order to make the energy density in this focal position less, calculating the offset amount of focal position a produces the position b, and the energy density of the same area presupposes that it becomes about half in this position b. And in this position b, it is assumed that the energy density of the same area becomes about half. Then, if the dielectric lens and the dielectric shell are provided so that it may take such a position, unexpected burning by sun rays, etc., can be prevented.

As shown in FIG. 9, in the 2nd embodiment, each radius of the inner surface of the sphere of dielectric shell 63 and the outer surface of the sphere of dielectric shell 63 is formed in a spherical form that has a radius longer than focal length R of dielectric lens 52. Therefore, all the light converged with dielectric lens 52 is converged on the position from which it separated from the surface of the sphere of dielectric shell 63. In the case of this embodiment, both are formed so that light may be converged between dielectric shell 63 and dielectric lens 52. Therefore, the surface of the sphere of dielectric shell 63 is safe from being heated.

Embodiment 3

In the case of the 1st and 2nd embodiments, dielectric shells 53 and 63 are formed in a spherical form of monolayer structure. In the case of the 3rd embodiment, dielectric shell 73 is formed in a multi-layered structure of a concentric circle between which gap 77 is disposed. Hereafter, this is explained. FIG. 10 shows the exemplary diagram showing the 3rd embodiment of the present invention. For the same portions as the 1st and 2nd embodiments, the same names and the same numbers are attached, and so the explanation is omitted.

As shown in FIG. 10, dielectric shell 73 is formed using the transparent dielectric member, and is formed in a multi-layered structure of a concentric circle between which gap 77 is placed. The radius of one surface of the sphere of this dielectric shell 73 is formed with a length equal to focal length R of dielectric lens 52. And in the state where it is centered on dielectric lens 52, the radius of one surface of the sphere of dielectric shell 73 of multi-layered structure positions dielectric shell 73 and dielectric lens 52 so that it may be located in focal length R of dielectric lens 52. The maintenance mechanism 74 in which dielectric lens 52 is held is formed inside of dielectric shell 73.

If a dielectric shell is irradiated and the optical path inside the dielectric shell is seen as shown in FIG. 11, it will be condensed in the center section, and, in the end, will spread conversely. Then, the following things became clear, judging from the result of the analysis output of the dielectric lens described previously. The optical paths of the electromagnetic waves which enter into the end of the dielectric lens do not gather for a focus, because they bend too much. Then, aperture efficiency can be enlarged if an optical path is amended. For that purpose, a dielectric shell is formed in a suitable spherical form, and it forms a multi-layered structure which has a suitable size and a suitable thickness of spherical shell. However, when a dielectric shell is formed in a multi-layered structure, reflection of electromagnetic waves increases, as does the number of times the waves penetrate the structure. Therefore, degradation of the performance by multi stage reflection occurs, and a broadband characteristic is not acquired. Then, it became clear that it was possible to obtain the transmissivity to a specific frequency, when it was narrowband, which can be equal to practical use.

Embodiment 4

The 4th embodiment of this invention forms still further a transparent dielectric coating 57 on the surface of the dielectric shell. Hereafter, it is explained based on FIGS. 12-14. FIG. 12 is an exemplary diagram showing the 4th embodiment of the present invention. FIG. 13 is a figure showing the relation between the specific inductive capacity of dielectric coating 57, and transmissivity. FIG. 14 is an explanatory diagram of light that enters into a medium. For the same portions as shown in the 1st-the 3rd embodiments, the same names and the same reference numerals are attached and the corresponding explanation is omitted.

As shown in FIG. 12, dielectric coat 57 is formed on the surface of dielectric shell 53. This dielectric coating 57 is formed by the transparent dielectric material with a specific inductive capacity of one or more, and the material has a dielectric constant smaller than the dielectric constant of dielectric lens 52 or dielectric shell 53. In this embodiment, although dielectric coating 57 is coated onto the surface of dielectric shell 53 of monolayer structure, it is not limited to this, and so the dielectric coating 57 may be formed on the back (inside) of dielectric shell 53, or may be provided on both sides of the surface and the back. Even if the dielectric coating is on the surface of one layer of dielectric shell 73 of multi-layered structure, an inside, both sides, or each class, there is the same effect.

Subsequently, as shown in FIG. 13, in order to observe how dielectric coating 57 formed in the dielectric shell influences the transmissivity of electromagnetic waves, the inventors examined the relationship between the specific inductive capacity of a dielectric coating, and the transmissivity of the electromagnetic waves that pass through this dielectric coating. In FIG. 13, the line "-●-●-●-" shows the result with only dielectric shell 53. The line "-■-■-■-" shows the result when dielectric coating 57 is formed on the surface of dielectric shell 53. Line "-Δ-Δ-Δ-" shows the result when dielectric coating 57 is formed on both sides of dielectric shell 53.

The inventors considered as follows the relationship between the specific inductive capacity of a dielectric coating, and the transmissivity of the electromagnetic waves that pass through these dielectrics. That is, if light enters into the border plane of the medium by which refractive indices differ, a part of the light will be reflected, and the remaining light will refract and transmit. Then, when a dielectric coating is coated on the surface of a dielectric shell, the inside of the dielectric shell, or both sides of the dielectric shell, the reflectance and transmissivity of light at the time of passing through the border plane of the dielectric coating and dielectric shell, which differ in dielectric constant, are considered.

As shown in FIG. 14, when light enters into medium 2 of refractive index n2 at angle α from the medium of refractive index n1, according to Snell's law, incidence angle α and angle of refraction β are expressed with the following formulas.

$$n1 \sin \alpha = n2 \sin \beta \quad (1)$$

However, the angle of reflection is equal to the incidence angle.

Regarding the electric vector of the incident light wave, the component which enters perpendicularly, the component of the reflected wave, and the component of the transmitted wave are made into Es, Es', Es", and Ep, Ep', and Ep" to the entrance plane (plane containing incident light and a normal line), respectively. The same may be said of a magnetic vector and the component of the incident wave which enters perpendicularly, the component of the reflected wave, and the component of the transmitted wave are made into Hs, Hs', Hs" and Hp, Hp', and Hp" to the entrance plane (plane containing incident light and a normal line) of the magnetic vector of light, respectively.

First, when an E vector enters perpendicularly to an entrance plane, as shown in FIG. 14, each component of the electric vector is perpendicular to the page space in s polarization. On the theory that it is continuous, a component parallel to a border plane will become equal to the component of a transmitted wave in a border plane, if the component of an incident wave and the component of a reflected wave are added. Therefore, the following equation (2) is formed.

$$Es+Es'=Es'' \tag{2}$$

On the other hand, as shown in FIG. 14, an H vector is in an entrance plane. A component parallel to those border planes continues. Therefore, the following formula is formed.

$$Hp\cos\alpha-Hp'\cos\alpha=Hp''\cos\beta \tag{3}$$

The relation of the size of an E vector and an H vector is decided from characteristic impedance Z1 and Z2 of a medium.

Therefore, it becomes the following formula.

$$E_s = Z_1 H_p,\ E_s' = Z_1 H_p',\ \left(Z_1 = \sqrt{\frac{\mu_1}{\varepsilon_1}}\right) \tag{4}$$

$$E_s'' = Z_2 H_p'',\ \left(Z_2 = \sqrt{\frac{\mu_2}{\varepsilon_2}}\right) \tag{5}$$

It will become formula (6) if formulae (4) and (5) are substituted for formula (3).

$$\frac{E_s}{Z_1}\cos\alpha - \frac{E_s'}{Z_1}\cos\alpha = \frac{E_s''}{Z_2}\cos\beta \tag{6}$$

By using formula (5) and formula (3), the amplitude ratio (amplitude reflectance) of an incident wave and a reflected wave and the amplitude ratio (amplitude transmittance) of an incident wave and a transmitted wave serve as formula (7) and formula (8) from FIG. 14, respectively.

$$r_s = \frac{E_s'}{E_s} = \frac{Z_2'\cos\alpha - Z_1\cos\beta}{Z_2\cos\alpha + Z_1\cos\beta}, \tag{7}$$

$$t_s = \frac{E_s''}{E_s} = \frac{2Z_2\cos\alpha}{Z_2\cos\alpha + Z_1\cos\beta} \tag{8}$$

Here, since it is (α=β=0), Z1'=Z1, and Z2'=Z2 when an incidence angle is 0, a formula (7) and a formula (8) turn into the following formulae (9) and (10), respectively.

$$r = \frac{Z_2 - Z_1}{Z_2 + Z_1}, \tag{9}$$

-continued $$t = \frac{2Z_2}{Z_2 + Z_1} \tag{10}$$

In the case of vertical incidence, since distinction of polarization direction is lost, subscript s is omitted.

Here, specific inductive capacity of the dielectric shell is set to ∈k. Specific inductive capacity of the dielectric coating is set to ∈r. Since the specific inductive capacity of air is 1, when not forming a dielectric coating in a dielectric shell, amplitude transmittance Tk is expressed by following formula (II).

$$T_k = \frac{2}{(1+\sqrt{\varepsilon_k})}\frac{2\sqrt{\varepsilon_k}}{(\sqrt{\varepsilon_k}+1)} = \frac{4\sqrt{\varepsilon_k}}{(1+\sqrt{\varepsilon_k})^2} \tag{11}$$

The explanation is omitted regarding an intermediate conversion type.

On the other hand, when a dielectric coating is provided on both sides of the dielectric shell, amplitude transmittance Tk is expressed with a following formula (12).

$$T_e = \frac{2}{(1+\sqrt{\varepsilon_r})}\frac{2\sqrt{\varepsilon_r}}{(\sqrt{\varepsilon_r}+\sqrt{\varepsilon_k})}\frac{2\sqrt{\varepsilon_k}}{(\sqrt{\varepsilon_k}+\sqrt{\varepsilon_r})}\frac{2\sqrt{\varepsilon_r}}{(\sqrt{\varepsilon_r}+1)} \tag{12}$$

If a middle value with the dielectric constant of air and the dielectric constant of a dielectric shell, i.e., the value of specific-inductive-capacity ∈k of the dielectric shell and specific-inductive-capacity Er of a dielectric coating, was set to 1≦∈r≦∈k, it became clear that the transmission property was improved. In the case of specific-inductive-capacity ∈k=3 of a dielectric shell, the relation between specific-inductive-capacity ∈ r of dielectric coating 57 and the transmissivity of the electromagnetic waves which pass through this dielectric coating 57 is shown in FIG. 11. In FIG. 11, the line "-●-●-●-" shows the result in the case of only a dielectric shell 53. Line "-■-■-■-" shows the result when dielectric coating 57 is formed on the surface of dielectric shell 53, and line "-Δ-Δ-Δ-" shows the result when dielectric coating 57 is formed on both sides of dielectric shell 53.

Embodiment 5

The 5th embodiment of the present invention is explained in detail with reference to FIG. 15. FIG. 15 is an exemplary diagram of the device (hereafter reflector) that reflects electromagnetic waves using a dielectric lens transparent to electromagnetic waves. Reflector 1 comprises spherical dielectric lens 2 which is transparent to electromagnetic waves, reflecting body 4 provided in the focal length of this dielectric lens 2, and color filter 5 arranged in this reflecting body 4 in the reflective surface of a position maintenance means, and the reflecting body 4 is at the focal length of dielectric lens 2. The position maintenance means is disposed at the focal length of dielectric lens 2 in reflecting body 4 and comprises dielectric lens 2, included in dielectric shell 3, and maintenance mechanism 6.

In the case of this fifth embodiment, dielectric lens 2 is formed in a spherical form using polystyrene resin as a transparent dielectric member with small dielectric loss.

Therefore, when electromagnetic waves (radio waves and light waves) pass the dielectric lens formed in this way, they are refracted, and the lens converges them on focus F.

Since the whole dielectric lens 2 is a transparent spherical form, it has omnidirectionality to electromagnetic waves. That is, it has omnidirectionality not only to the radio wave band but also to the light wave band. In the case of Embodiment 5, dielectric lens 2 is formed in a spherical form using the transparent dielectric member. The specific inductive capacity of this dielectric member is 3.5 or less.

Dielectric shell 3 is formed by a transparent member, i.e., a dielectric member of small dielectric loss, transparent to electromagnetic waves, and the inside is formed in a hollow spherical form. The radius of the inside of dielectric shell 3 or the radius of the external surface of dielectric shell 3, i.e., the radius of one surface of a sphere of dielectric shells 3, is formed in a spherical form which serves as a radius equal to focal length R of dielectric lens 2.

A position maintenance means carries out position maintenance of the reflecting body 4 at focal length R of dielectric lens 2, and has an inside diameter or an outer diameter equal to focal length R. This position maintenance means comprises dielectric shell 3 and maintenance mechanism 6. This dielectric shell 3 is formed by a member transparent to electromagnetic waves, and is formed in a hollow inside that can store dielectric lens 2. Maintenance mechanism 6 can carry out position maintenance of the dielectric shell 3 and dielectric lens 2 so that this dielectric shell 3 may be in the state that has dielectric lens 2 and dielectric shell 3 located along focal length R.

As shown in FIG. 17, in the case of this embodiment, maintenance mechanism 6 (FIG. 3 has indicated maintenance mechanism 54) is formed in the same shape as that which the inventors describe previously. Maintenance mechanism 6 is not limited to this embodiment. As maintenance mechanism 6 includes dielectric lens 2 in the internal central part of dielectric shell 3 and one surface of a sphere of dielectric shell 3 is located along focal length R, as long as it is the structure which can carry out position maintenance of dielectric shell 3 and the dielectric lens 2, it may be another sort of structure.

Electromagnetic reflecting body 4 is arranged and positioned on the surface of a sphere of either the inside of dielectric shell 3, or the external surface of dielectric shell 3. Dielectric shell 3 is located in focal length R of dielectric lens 2. Color filter 5 is arranged in the reflective surface of reflecting body 4.

Reflected light turns into the same light as the color of color filter 5. Therefore, if color filter 5 of three colors of red, blue, and yellow is arranged with regard to the reflective surface of reflecting body 4 established in three dielectric lenses 2, respectively, a passivity type reflector of three colors will be formed. If the reflector of these three colors is controlled by a signal which controls a traffic signal, the reflector of three colors can be used as a passivity type traffic signal.

Instead of a color filter, a liquid crystal may be arranged in the reflective surface of a reflecting body, or both a color filter and a liquid crystal may be arranged with regard to it. As shown in FIG. 18 mentioned later, for a position maintenance means, shade cap 31 which intercepts the sun rays irradiated by the dielectric lens may be arranged. Light scattering material (for example, a prism, etc.) may be allocated in a position maintenance means instead of a shade cap.

A window is provided in a position maintenance means (this embodiment relates to dielectric shell 3). And in the window, either a color filter or a liquid crystal or both may be arranged. In this case, a reflector which has a coloring function to reflect desired colors is obtained by choosing the color of the color filter or liquid crystal as desired. Since a power supply is not usually needed, the reflector that has this coloring function can be semi-perpetually used, once it is installed. If a solar cell (for example, solar cell 21 shown in FIG. 17 mentioned later) is allocated in a position maintenance means when a liquid crystal is used for the reflective surface and window of a reflecting body, a reflector need not have a special power supply for liquid crystals, and can be used semi-perpetually. The arrangement place of a solar cell need not be limited to the place shown in FIG. 17, but as long as it is in a position which can receive sun rays and it is in a position that can supply electric power to the liquid crystal, it may be another sort of part.

Embodiment 6

The 6th embodiment of this invention is explained in detail with reference to FIG. 1, FIG. 15, and FIG. 16. FIG. 16 is an illustrative diagram of cylindrical long bar reflector 10. This sixth embodiment shows the use of bar reflector 10. The portions the same as in the fifth embodiment are given the same names and the same reference numerals, and the corresponding explanation is omitted.

In the sixth embodiment, a position maintenance means carries out position maintenance of the reflecting body at focal length R of dielectric lens 2, and this position maintenance means comprises cylindrical container 11 and the maintenance mechanism that carries out position maintenance of the cylindrical container 11 and each dielectric lens 2. The cylindrical container 11 is formed by a member transparent to electromagnetic waves. The inside diameter or outer diameter of cylindrical container 11 is equal to focal length R of dielectric lens 2, and the inside of cylindrical container 11 forms a hollow inside that can store two or more dielectric lenses. The maintenance mechanism is disposed to carry out position maintenance of cylindrical container 11 and each dielectric lens 2. Cylindrical container 11 is disposed so that dielectric lens 2 is included, and position maintenance of the reflecting body 14 is carried out so that it may be located along focal length R of each dielectric lens 2.

Cylindrical container 11 is formed cylindrically by a member transparent to electromagnetic waves, the inside hollow, and the lower end closed at the flat bottom 11*a*. Inside cylindrical container 11, two or more dielectric lenses 2 are stored. The maintenance mechanism (not shown) which carries out position maintenance of cylindrical container 11 and each dielectric lens 2 is established so that reflecting body 14 may be positioned along focal length R of each dielectric lens 2 stored inside cylindrical container 11. The upper end of this cylindrical container 11 is covered by cap part 11*b* which can be opened and closed freely. If each of bottom 11*a* and cap part 11*b* of cylindrical container 11 are members transparent to electromagnetic waves, bar reflector 10 will be obtained.

Since it is formed in this way, bar reflector 10 of arbitrary length can be formed with a number of the reflectors stored inside cylindrical container 11. Bar reflector 10 of the color desired can be formed with color filter 15 arranged on the reflective surface of reflecting body 14. If bottom 11*a* of bar reflector 10 is made to include a weight, bar reflector 10 can be stabilized. Therefore, this bar reflector 10 can be semi-perpetually used also as a road sign laid on a road without supply of electric power. It is further possible that weight is not put into bottom 11*a* of bar reflector 10, and if cylindrical container 11, the dielectric lens which it has inside, and reflecting body 14 are made into a portable size and a portable handle is attached to bottom 11*a*, they are usable for traffic control and the like, and also usable as a passivity type guidance rod. At a place without an airport, a temporary runway can be prepared easily. When using it for a radar apparatus and guiding a movable body and the like automatically, it can be used as a passivity type marker.

This embodiment describes the case where a color filter is arranged with regard to the reflective surface of the reflecting body. However, in the reflective surface of the reflecting body, even if a liquid crystal is provided or both a color filter and a liquid crystal are provided, the same effect arises.

In order to prevent dielectric shell 3 from being heated by converging sun rays on the surface of dielectric shell 3 with dielectric lens 2, shade cap 31 for intercepting sun rays may be formed as a bar reflector. Instead of shade cap 31, light scattering material, for example, a prism, may be provided.

Like the fifth embodiment, a window may be provided in a position maintenance means (this embodiment relates to dielectric shell 3), and either a color filter or a liquid crystal or both may be arranged in this window. In this case, a bar reflector which has the ability to reflect arbitrary colors is obtained by choosing the color of a color filter or a liquid crystal arbitrarily. Usually, since a bar reflector does not need a power supply, once it is installed, it can be used semi-perpetually. In a bar reflector, if a solar cell (for example, solar cell 21 shown in FIG. 17 mentioned later) is arranged for a position maintenance means when a liquid crystal is used for the reflective surface and window of a reflecting body, a bar reflector does not require a special power supply for liquid crystals, and can be used semi-perpetually. Without being limited to the arrangement shown in FIG. 17, as long as the arrangement place of a solar cell is a place that can receive sun rays and is a place that can supply electric power to the liquid crystal, it may be another sort of part.

Embodiment 7

The 7th embodiment of this invention is explained with reference to FIG. 1, FIG. 15, and FIG. 17. FIG. 17 shows the exemplary diagram of reflector 20. This reflector 20 has an electric control function with built in solar cell 31. The same portions as Embodiment 5 and Embodiment 6 are referred to by the same names and the same reference numerals, and the corresponding explanation is omitted.

In the seventh embodiment, a position maintenance means positions a reflecting body to focal length R of dielectric lens 2. This position maintenance means comprises maintenance mechanism 6 which carries out position maintenance of dielectric shell 3, this dielectric shell 3, and the dielectric lens 2. Dielectric shell 3 has an inside diameter or an outer diameter equal to focal length R, is formed by a member transparent to electromagnetic waves, and is formed with a hollow inside that can store dielectric lens 2. Maintenance mechanism 6 is disposed to carry out position maintenance of dielectric shell 3 and the dielectric lens 2. This maintenance mechanism 6 is disposed to carry out position maintenance of the dielectric shell 3 and dielectric lens 2 so that dielectric lens 2 and dielectric shell 3 may be located along focal length R.

In the case of the seventh embodiment as well as the case of the fifth embodiment, maintenance mechanism 6 (FIG. 1 shows maintenance mechanism 54) is formed in the same form shown in FIG. 1. Maintenance mechanism 6 is not limited to this embodiment. As maintenance mechanism 6 includes dielectric lens 2 in the internal central part of dielectric shell 3 and one surface of a sphere of dielectric shell 3 is located along focal length R, as long as it is a structure which can carry out position maintenance of dielectric shell 3 and the dielectric lens 2, it may be another sort of structure.

Solar cell 21 is arranged on the inside or the outside of dielectric shell 3. Either the inner surface of a sphere of dielectric shell 3 or the outer surface of a sphere of dielectric shell 3 is located in the focal length of dielectric lens 2. Light sources 22*a*, such as electric control reflecting body 22 or an LED, are arranged and positioned by either this inner surface of the sphere or outer surface of the sphere. Either electric control reflecting body 22 or light source 22*a* are constructed so that electric power may be supplied by solar cell 21.

Since it is constructed in this way, when electric control reflecting body 22 is provided, reflector 20, which has an electric control function, can transmit an electric control signal. Therefore, reflector 20 can be used as a range marker as radio wave LGTs, such as ground and marine. When light sources, such as LEDs, are arranged at reflector 20 that has an electric control function, it can be used as a sign on the ground or a marine semipermanent light, or similarly, as a range marker. Reflector 20 which has an electric control function can be installed in any number of places, such as in the mountains or in a desert. Even if it is a place without an airport, by arranging reflector 20 that has an electric control function, a temporary runway can be prepared easily. When using reflector 20 which has an electric control function for a radar apparatus, reflector 20 can be used as a marker for automatic guidance.

Like the case of each above-mentioned embodiment, a color filter may be arranged in the reflective surface of the reflecting body of reflector 20 that has an electric control function, or a liquid crystal may be provided instead of a color filter, or both a color filter and a liquid crystal may be provided. For a position maintenance means of reflector 20 to have an electric control function, a window may be provided, and either a color filter or a liquid crystal may be arranged in this window, or both may be arranged there. In this case, the reflector which has the ability to reflect desired colors is obtained by choosing as desired the color of a color filter and the color of a liquid crystal that are provided. Usually, reflector 20 which has an electric control function does not need a power supply. Therefore, once the reflector 20 is installed, it can be used semi-perpetually. All have the same effect.

Embodiment 8

The eighth embodiment of this invention is explained based on FIG. 15, FIG. 17, and FIG. 18. FIG. 18 shows the exemplary diagram of heating prevention type reflector 30, and shows the case where shade cap 31 is formed in dielectric shell 3. The same portions as in the fifth through seventh embodiments are associated with the same names and the same reference numerals, and the corresponding explanations are omitted.

Since dielectric shell 3 is arranged along focal length R of dielectric lens 2, when dielectric lens 2 is used with the light wave band, it converges sun rays on the surface of dielectric shell 3 with dielectric lens 2, and there is a problem that dielectric shell 3 is heated. When receiving energy is small, it seldom becomes a problem, but when receiving energy is large, dielectric shell 3 is heated and it becomes a problem.

Then, in this embodiment, as shown in FIG. 18, shade cap 31 is arranged at either the inside of dielectric shell 3, or the outside so that the sun rays from the upper part irradiated by dielectric lens 2 may be covered. And dielectric shell 3 is arranged so that it may be located along focal length R of dielectric lens 2. Therefore, since the sun rays from the upper part are blocked with shade cap 31, dielectric shell 3 is not heated.

Since sun rays are scattered about when light scattering material is provided instead of shade cap 31 (for example, when a prism has been provided), dielectric shell 3 is not heated and it is safe.

The reflector of this embodiment is constructed by disposing a reflecting body in the focal length of a dielectric lens. Then, if the electromagnetic wave generating body is provided instead of a reflecting body, a generator of electromagnetic waves using a dielectric lens will be obtained.

Embodiment 9

The ninth embodiment of this invention is explained based on FIG. 15, FIG. 17, and FIG. 18. In this embodiment, reflecting body 34*a* of the form provided with a slit in reflecting body 34, or reflecting body 34*b* of the form having metal pieces separated by a predetermined distance. The same portions as in the first through fourth embodiment are attached to the same name and the same number, and the corresponding explanation is omitted.

Reflecting body 34*a* with a slit is formed in focal length R of dielectric lens 2 as reflecting body 34 the reflects the signal converged on the focus. Alternately reflecting body 34*b* is formed in focal length R of dielectric lens 2. This reflecting body 34*b* is formed by providing metal pieces separated by a predetermined distance.

When reflecting bodies 34*a* and 34*b* are formed in the above shape, the electromagnetic waves emitted by the movable body side are reflected by reflecting body 34. So, in the movable body side, by measuring the time until it receives this reflected electromagnetic wave, the distance between one's self and the position in which reflector 30 is installed can be determined.

The information coded on the electromagnetic waves reflected by reflecting body 34 according to the arrangement state of the slit of reflecting body 34*a* with a slit can be added. For example, the information added to this reflective electromagnetic wave may be the identification information of reflector 30 that made the position known. In the movable body side, positioning can be performed by receiving the reflective electromagnetic waves of three or more reflectors 30. Thus, reflector 30 that has a positioning function is obtained from the reflective electromagnetic waves from a slit. Since sun rays are covered with shade cap 31, they can avoid convergence of sun rays by a focus of dielectric lens 2 to the surface of dielectric shell 3. Therefore, reflector 30 is safe, without heating dielectric shell 3.

In the case of each above-mentioned embodiment, a color filter may be provided on the reflective surface of the reflecting body, a liquid crystal may be provided instead of a color filter, or both a color filter and a liquid crystal may be provided. A window may be provided in a position maintenance means, and either a color filter, or a liquid crystal or both may be arranged in this window. In this case, a reflector which has a coloring function to reflect arbitrary colors is obtained by choosing a color of a color filter, and likewise a color of a liquid crystal may be selected like each above-mentioned embodiments. Usually, since a power supply is not needed, this reflector can be semi-perpetually used, once it is installed.

If a liquid crystal is used for the reflective surface and window of a reflecting body and a position maintenance means is allocated in a solar cell (for example, solar cell 21 shown in FIG. 17) like the case of each above-mentioned embodiments, there is no the requirement to establish a special power supply for liquid crystals in the reflector, and it can be used semi-perpetually. As long as the arrangement place of a solar cell is a place which can receive sun rays and is a place which can supply electric power to the liquid crystal, it may be another sort of arrangement. As shown in FIG. 18, a solar cell can also be arranged on the upper surface of shade cap 31.

In the case of each above-mentioned embodiments, all arrange a reflecting body in the focal length of a dielectric lens, and comprise the reflector, but if an electromagnetic wave generating body is arranged instead of a reflecting body, a generator of electromagnetic waves using a dielectric lens will be similarly obtained.

Embodiment 10

The 10th embodiment of this invention is explained based on FIGS. 19-20. FIG. 19 is a exemplary diagram of reflector 40 which stored dielectric lens 2 in case 41. FIG. 20 is a exemplary diagram of reflector 50 which stored many dielectric lenses 2 in large-scale case 51 which can store two or more dielectric lenses 2. The same things here as shown in the fifth through ninth embodiments are attached to the same name and the same number, and so the explanation is omitted.

As shown in FIG. 19, a position maintenance means positions and holds reflecting body 44 in focal length R of dielectric lens 2. This position maintenance means comprises maintenance mechanism 46 and case 41. Therefore, dielectric lens 2 is included at the end of this position maintenance means, and maintenance mechanism 46 is formed in it so that reflecting body 44 may be located along focal length R of dielectric lens 2, and position maintenance of the dielectric lens 2 may be carried out. The other end of a position maintenance means is cylindrical case 41 opened wide, or is cylindrical case 41 covered with the cover object formed by the member transparent to electromagnetic waves. Single dielectric lens 2 is stored inside this case 41. In the case of this embodiment, as shown in FIG. 19, the maintenance mechanism which carries out position maintenance of the dielectric lens 2 is formed in the shape of a truncated sphere and a concave portion which can hold some dielectric lenses 2 is provided in the center section.

Reflecting body 44 that reflects electromagnetic waves is provided at this maintenance mechanism 46.

Since it is constructed in this way, incidence electromagnetic waves are reflected by reflecting body 44. Therefore, reflector 40 can be used as a small radar reflector or a light reflex machine. It can use also as a reflecting plate currently used with brake lights and tail lights, such as vehicles. Since dielectric lens 2 is held at the state where it fixed strongly, by maintenance mechanism 46 which carries out position maintenance of case 41 and the dielectric lens 2, destruction, damage, mechanical modification, and the like do not arise.

Dielectric lens 2, maintenance mechanism 56 which carries out position maintenance of this dielectric lens 2, and reflecting body 54, as shown in FIG. 20, are made to match the same arrangement relationship as maintenance mechanism 46 and reflecting body 44, as shown in FIG. 19. Subsequently, where this arrangement relationship is held, dielectric lens 2, maintenance mechanism 56 which carries out position maintenance of this dielectric lens 2, and reflecting body 54 are stored in a flat state, and are stored in large-scale case 51 which store two or more. If formed in this way, large-sized reflector 50 which can be used for the reflecting plate used as the large-sized brake light and tail light of a size of case 51, a radar reflector, and the like will be obtained.

When the color filter has been provided to the reflective surface of reflecting bodies 44 and 54, reflectors 40 and 50 of the color of the arbitrary small and large-sized sizes which have a coloring function are obtained. In the reflective surface of reflecting bodies 44 and 54, a liquid crystal may be arranged instead of a color filter, and both a color filter and a liquid crystal may be further provided. On the cover object of cases 41 and 51 shown in FIGS. 19 and 20, either a color filter, or a liquid crystal, or both may be provided.

When a reflector which has a reflecting body, light sources, such as LEDs, or transmitters which have a transmitting function are installed so that it may be located in the focal length R of the dielectric lens, the device which has a reflective function, a light emitting function, and a transmitting function, respectively, are obtained. Here, when the color filter has been further arranged on the reflective surface of a reflecting body, it can be used as brake lights and tail lights, such as on vehicles.

Although the reflector of this embodiment is comprised by arranging a reflecting body in the focal length of a dielectric lens, if the generating body of electromagnetic waves is arranged instead of a reflecting body, the generator of electromagnetic waves using a dielectric lens will be similarly obtained like the case of each of the above-mentioned embodiments.

In the above-mentioned fifth through tenth embodiments, although the shape of dielectric lens 2 is presented as spherical, it is not limited to this, naturally, a dielectric lens of a hemisphere form may be used instead of a spherical dielectric lens. In this case, the same effect as the case where a spherical dielectric lens is used is obtained. Since occupied volume of the lens is halved, the volumetric efficiency is good.

Here, as an example, as shown in FIG. 21, reflector 100 with a dielectric lens 102 of hemispherical form is explained. 103 is a dielectric shell of a hemispherical form. This dielectric shell 103 is arranged along the focal length of dielectric lens 102 of hemispherical form. 104 is a reflecting body. The position maintenance means is disposed to carry out position maintenance of this reflecting body 104 at focal length R of dielectric lens 102 of a hemispherical form. And the maintenance mechanism (not shown) is disposed to carry out position maintenance of dielectric shell 103 and dielectric lens 102 of a hemispherical form, and is disposed to position them so that reflecting body 104 may be installed in the section side of dielectric lens 102 and dielectric shell 103. Dielectric shell 103 of hemispherical form has an inside diameter or an outer diameter equal to focal length R, and forms a hollow inside that can store dielectric lens 102 of a member transparent to electromagnetic waves. The maintenance mechanism disposed to carry out position maintenance of dielectric shell 103 and the dielectric lens 102 is carrying out position maintenance of this dielectric shell 103 and dielectric lens 102 so that dielectric lens 102 and dielectric shell 103 may be located along focal length R.

As shown in FIG. 21, when electromagnetic waves 110 enter from just beside dielectric lens 102, this electromagnetic wave 110 comes to a focus at focus 1. When electromagnetic waves 120 enter from across dielectric lens 102, this electromagnetic wave 120 comes to a focus at focus 2 arrived at via specular reflection from what would be the original focus by reflecting body 104 currently installed in the section side of dielectric lens 102. Therefore, the area efficiency of the aperture plane in the case of oblique incidence is determined by the area of the reflecting body installed in the section.

As shown in FIG. 22, when the angle of the incidence direction of electromagnetic waves and an axis perpendicular to a reflecting body to make is angle θ, radius r of a reflecting body required for total internal reflection is $R=r/\cos\theta$. Therefore, when using the dielectric lens of a hemispherical form, reflective effectiveness is related in this way, but other aspects are the same as that of the case where a spherical dielectric lens is used.

In the case of this embodiment, in the reflective surface of a reflecting body, either a color filter, or a liquid crystal, or both, may be arranged like each of the above-mentioned embodiments. A window may be provided in a position maintenance means and either a color filter, or a liquid crystal, or both may be arranged in this window.

In this case, the reflector which has a coloring function to reflect desired colors is obtained by choosing the color of the color filter, or by choosing a liquid crystal as desired. Usually, since a power supply is not needed, this reflector can be semi-perpetually used, once it is installed. When a liquid crystal is used for the reflective surface or window of a reflecting body, if a solar cell (for example, solar cell 21 shown in FIG. 17) is disposed in a position maintenance means, there is no necessity of providing a special power supply for liquid crystals in it, and it can be semi-perpetually used. As long as the arrangement of the solar cell is in a place which can receive sun rays and is a place which can supply electric power to the liquid crystal, it may be that kind of place.

Although the reflector of this embodiment arranges the reflecting body in the focal length of a dielectric lens, if an electromagnetic wave generating body is arranged instead of a reflecting body, the generator of electromagnetic waves using a dielectric lens will be obtained.

Embodiment 11

The 11th embodiment of this invention is explained with reference to FIGS. 23-24. FIG. 23 is an exemplary diagram of reflector 60 which has reflecting bodies 64*a*-64*c* which take the form of a color filter of three kinds of colors. FIG. 24 shows the principle figure in the case of having arranged the traffic signal which use this reflector 60 on 4 corners of a traffic intersection. The same items as in the fifth through ninth embodiments are given the same names and the same reference numerals, and the corresponding explanation is omitted.

Reflector 60 is arranged at the center of 4 corners of the intersection. Vehicles 67 (67*a*-67*d*) have run or stopped toward the center of 4 the for corners of the intersection. Rolling mechanism 68 is arranged in the bottom of dielectric shell 3. This rolling mechanism 68 rotates reflector 60 with fixed rotational speed by with the axis of rotation as a perpendicular direction. The power supply of rolling mechanism 68 is supplied by solar cell 21. Reflecting body 64 is arranged in the surface of either the inside of dielectric shell 3, or the outside of dielectric shell 3 and is arranged with focal length R of dielectric lens 2. This reflecting body 64 is positioned by maintenance mechanism 6 which carries out position maintenance of the dielectric lens 2.

Reflecting body 64 is comprised by three kinds of reflecting bodies which consist of reflecting bodies 64*a* which have a blue color filter arranged with regard to the reflective surface, reflecting bodies 64*b* which have a yellow color filter arranged with regard to the reflective surface, and reflecting bodies 64*c* which have a red color filter arranged with regard to the reflective surface. In the traffic signal, these reflecting bodies 64*a*-64*c* are distributed in order corresponding to an indication rate of the green light, the yellow signal, and the red signal, and if the transition blue→yellow→red is considered one cycle, a single rotation of reflector 60 is distributed so that it occupies two cycles.

In this state, as shown in FIG. 24, if vehicles 67*a* apply a light to reflector 60, the light will be reflected by reflecting body 64*a*, and reflected light will serve as blue color. Therefore, the driver of vehicles 67*a* will see a green light. Similarly vehicles 67*c* can be made to see a green light. Since vehicles 67*b* and 67*d* exposed to reflecting body 64*c*, the reflected light takes on a red color and the vehicles [67*b* and 67*d*] driver will see a red light.

By rolling mechanism 68, reflector 60 rotates at a fixed speed which occupies two cycles in one revolution, when the transition green→yellow→red is one cycle. In this embodiment, reflector 60 is rotating clockwise. For example, the light of vehicles 67*a* will be reflected by each reflecting body in order of reflecting body 64*a*→64*b*→64*c*, if time passes. Therefore, the driver of vehicles 67*a* can recognize changing lights, with green light→yellow light→red light. The same may be said of other vehicles.

As shown in Embodiment 9, the slit which has the information on a green light, a yellow light, and a red light is provided in reflecting body 64. On the other hand, when each vehicles 67 emit electromagnetic waves and it receives a reflected wave, the information on a green light, a yellow light, and a red light can be obtained from reflective electromagnetic waves. If comprised in this way, when operating automatically with a radar apparatus which a vehicle carries in itself, a traffic signal can be used as a reflector for operational control of a vehicle.

In the case of this embodiment as well as each above-mentioned embodiment, either a color filter, or a liquid crystal, or both may be arranged with regard to a reflective surface of a reflecting body. A window may be provided in a position maintenance means and either a color filter, or a liquid crystal, or both may be arranged in this window. In this case, a reflector which has a coloring function to reflect arbitrary colors is obtained by choosing a color of a color filter or a liquid crystal, as desired. Usually, since this reflector does not need a power supply, once it is installed, it can be used semi-perpetually. When a liquid crystal is used for a reflective surface or a window of a reflecting body, if a solar cell (for example, solar cell 21 shown in FIG. 17) is allocated in a position maintenance means, there is no necessity of establishing a special power supply for liquid crystals in it, and it can be semi-perpetually used for it. As long as an arrangement place of a solar cell is a place which can receive sun rays and is a place which can supply electric power to a liquid crystal, it may be another sort of place.

Although a reflector of this embodiment is disposed as a reflecting body in a focal length of a dielectric lens, if an electromagnetic wave generating body is arranged instead of a reflecting body, a traffic signal using a generator of electromagnetic waves will be obtained similarly.

INDUSTRIAL APPLICABILITY

Since the device using the dielectric lens which has the omnidirectionality by this invention does not need a power supply, it is available in spite of being used indoor and in the outdoors. If a device using a dielectric lens is installed in a side wall of a road or the like, it is available as a reflecting plate detectable in a light of vehicles, or a reflecting plate detectable with a radar installation carried in vehicles. A device using a dielectric lens can be used as the guide light of a runway of a district airport. A device using a dielectric lens can be used also as the guide light of a runway of a temporary airport in an area without airports, such as a desert. The device using a dielectric lens can be installed in not only the ground but in a marine buoy, the mast of a vessel, etc., and can be made into a target.

A thing of the form having arranged a dielectric lens in a case provided with a reflecting body can be used also as brake lights and tail lights, such as vehicles. The thing of the form which has arranged a color filter of green, yellow, and red with regard to a reflecting body can use a traffic signal as a reflector for operational control, when operating vehicles automatically with a radar apparatus carried in vehicles. A traffic signal of a simple type using a reflector or a generator can also be constructed.

The invention claimed is:

1. A dielectric lens device comprising:

(a) a dielectric lens;

(b) a dielectric shell; and (c) a maintenance mechanism, wherein the dielectric lens has a focal length and is transparent to electromagnetic waves selected from one or more of the group consisting of electromagnetic waves of a first visible light wave band and a first radio wave band, and the dielectric shell is transparent to electromagnetic waves selected from one or more of the group consisting of electromagnetic waves of a second visible light wave band and a second radio wave band, wherein an inside of the dielectric shell is hollow, and the dielectric shell has a surface, wherein a radius of the surface is equal to the focal length of the dielectric lens, and the maintenance mechanism is disposed to position the dielectric shell and the dielectric lens so that the dielectric lens is included in an internal central part of the dielectric shell and so that the dielectric shell is locatable by the maintenance mechanism along the focal length of the dielectric lens.

2. A device according to claim 1, wherein said dielectric lens has a single structure with a specific inductive capacity of 3.5 or less formed with a transparent dielectric.

3. A device according to claim 2, wherein a dielectric coating with a specific inductive capacity of one or more is provided on a whole surface of said dielectric lens or said dielectric shell, wherein the dielectric coating is formed by transparent dielectric material with a dielectric constant smaller than the dielectric constant of said dielectric lens or said dielectric shell.

4. A device according to claim 2, wherein said dielectric shell is formed by a transparent dielectric member and comprises a multi-layered structure forming a concentric circle comprising a gap, wherein a radius of one surface of the multi-layered structure has a length equal to the focal length of said dielectric lens, and said maintenance mechanism is disposed to maintain a position of said dielectric shell and said dielectric lens of the multi-layered structure so that the radius of one surface of a sphere of said dielectric shell of said multi-layered structure is located in the focal length of said dielectric lens.

5. A device according to claim 2, wherein said dielectric lens is formed with transparent polystyrene resin.

6. A device according to claim 1, wherein each surface of said dielectric shell has a radius beyond a distance of said dielectric shell calculated from the focal length of said dielectric lens.

7. A device according to claim 1, further comprising:

(d) a reflecting body that reflects electromagnetic waves in the focal length of said dielectric lens.

8. A device according to claim 1, further comprising:

(d) an electromagnetic wave receiving section disposed to receive electromagnetic waves in the focal length of said dielectric lens.

9. A device according to claim 1, further comprising:

(d) a reflecting body disposed to reflect electromagnetic waves; and (e) an electromagnetic wave receiving section that receives electromagnetic waves, wherein the reflecting are disposed in the focal length of said dielectric lens.

10. A device according to claim 1, wherein said dielectric shell has a thickness of 3 mm or less and is formed with polycarbonate resin.

11. A device according to claim 1, wherein said dielectric shell has a thickness of 3 mm or less and is formed with acrylic resin.

12. A device according to claim 1, wherein said dielectric lens is a single structure formed of transparent dielectric with a specific inductive capacity of 3.5 or less, and said dielectric shell is formed with polycarbonate resin having a thickness of 3 mm or less.

13. A device according to claim 1, wherein said dielectric lens is a single structure formed with transparent dielectric having specific inductive capacity of 3.5 or less, and said dielectric shell is formed with acrylic resin having a thickness of 3 mm or less.

14. A device for reflecting electromagnetic waves, comprising:

(a) a dielectric lens having a focal length;

(b) an electromagnetic wave reflecting body having a reflecting surface; and (c) a position maintenance means, wherein the dielectric lens is transparent to electromagnetic waves selected from the group consisting of a first visible light wave band and a first radio wave band, wherein the reflecting body is provided in the focal length of the dielectric lens, and wherein the position maintenance means is disposed to maintain a position of the reflecting body at the focal length of the dielectric lens, wherein the position maintenance means comprises a dielectric shell and a maintenance mechanism, wherein the dielectric shell is transparent to electromagnetic waves selected from one or more of the group consisting of electromagnetic waves of a second visible light wave band and a second radio wave band, and the dielectric shell has a surface defining an inside diameter or an outer diameter equal to the focal length, wherein the dielectric shell is form by a member transparent to electromagnetic waves selected from the group consisting of the second visible light wave band and the second radio wave band, and forms a hollow sufficient in size to store the dielectric lens, wherein the maintenance mechanism is disposed to maintain a position of the dielectric shell and the dielectric lens so that the dielectric shell includes the dielectric lens and is locatable along the focal length of the dielectric lens, and wherein either a color filter, a liquid crystal, or both the color filter and the liquid crystal, are disposed in the reflective surface of the reflecting body.

15. A device for reflecting electromagnetic waves comprising:

(a) two or more dielectric lenses;

(b) an electromagnetic wave reflecting body; and (c) a position maintenance means, wherein each dielectric lens has a focal length and is transparent to electromagnetic waves selected from the group consisting of electromagnetic waves of a first visible light wave band and a first radio wave band, wherein the reflecting body is provided in the focal length of each dielectric lens, wherein the position maintenance means is disposed to maintain a position of the reflecting body at the focal length of each dielectric lens, and wherein the position maintenance means comprises a cylindrical container and a maintenance mechanism, wherein the cylindrical container is formed by a member transparent to electromagnetic waves selected from the group consisting of electromagnetic waves of a second visible light wave band and a second radio wave band, wherein the cylindrical container has a surface the defines an inside diameter or an outer diameter equal to the focal length and forms a hollow structure sufficient in size to store the two or more dielectric lenses, and wherein the maintenance mechanism is disposed to maintain a position of the cylindrical container and each of the two or more dielectric lenses so that the cylindrical container is locatable along the focal length of each of the two or more dielectric lenses.

16. The device according to claim 15, wherein either a color filter, or a liquid crystal, or both the color filter and the liquid crystal, are arranged in a reflective surface of said reflecting body.

17. A device for reflecting electromagnetic waves comprising:

(a) a dielectric lens;

(b) an electromagnetic wave reflecting body; and (c) a position maintenance means, wherein the dielectric lens has a focal length and is transparent to electromagnetic waves selected from the group consisting of electromagnetic waves of a visible light wave band and a radio wave band, wherein the reflecting body is provided in the focal length of the dielectric lens, and the position maintenance means is disposed to maintain a position of the reflecting body at the focal length of the dielectric lens, wherein the reflecting body has a slit, or metal pieces separated from one another, and the reflecting body is disposed to detect a reflective direction of reflective electromagnetic waves passing through the slit.

18. A device for reflecting electromagnetic waves, comprising:

(a) a dielectric lens having a focal length;

(b) an electromagnetic wave reflecting body;

(c) a position maintenance means; and (d) a case that includes the dielectric lens, wherein the case has two ends, wherein the dielectric lens is transparent to electromagnetic waves selected from the group consisting of a first visible light wave band and a first radio wave band, wherein the reflecting body is provided in the focal length of the dielectric lens, and wherein the position maintenance means is disposed to maintain a position of the reflecting body at the focal length of the dielectric lens, wherein the position maintenance means comprises a maintenance mechanism disposed to maintain a position of the dielectric lens, and wherein the position of the dielectric lens is maintained so that the reflecting body is locatable along the focal length of the dielectric lens, and wherein the maintenance mechanism is disposed at a first end of the case and a second end of the case is opened wide, or the second end of the case is covered with a cover object formed by a member transparent to electromagnetic waves selected from the group consisting of a second visible light wave band and a radio wave band.

19. A device according to claim 18, further comprising:

(e) a window provided in said position maintenance means, and either a color filter, or a liquid crystal, or both the color filter and the liquid crystal, arranged in this window.

20. A device for reflecting electromagnetic waves, comprising:

(a) a dielectric lens having a focal length;

(b) an electromagnetic wave reflecting body;

(c) a position maintenance means, wherein the dielectric lens is transparent to electromagnetic waves selected from the group consisting of a visible light wave band and a radio wave band, wherein the reflecting body is provided in the focal length of the dielectric lens, and wherein the position maintenance means is disposed to maintain a position of the reflecting body at the focal length of the dielectric lens, and the reflecting body further comprises an electrically controlled reflecting body disposed to control electromagnetic waves; and (d) a power supply disposed in the electrically controlled reflecting body and having a solar cell.

21. A device for reflecting electromagnetic waves, comprising:

(a) a dielectric lens having a focal length;

(b) an electromagnetic wave reflecting body; and (c) a position maintenance means, wherein the dielectric lens is transparent to electromagnetic waves selected from the group consisting of a first visible light wave band and a first radio wave band, wherein the reflecting body is provided in the focal length of the dielectric lens, and wherein the position maintenance means is disposed to maintain a position of the reflecting body at the focal length of the dielectric lens, wherein the position maintenance means comprises a dielectric shell and a maintenance mechanism, wherein the dielectric shell is transparent to electromagnetic waves of a second visible light wave band and a second radio wave band, and the dielectric shell has a surface defining an inside diameter or an outer diameter equal to the focal length, wherein the dielectric shell is formed by a member transparent to electromagnetic waves selected from the group consisting of the second visible light wave band and the second radio wave band, and forms a hollow sufficient in size to store the dielectric lens, wherein the maintenance mechanism is disposed to maintain a position of the dielectric shell and the dielectric lens so that the dielectric shell includes the dielectric lens, and the dielectric shell is locatable along the focal length of the dielectric lens, and wherein either a color filter, a liquid crystal, or both the color filter and the liquid crystal, are arranged in the reflective surface of the reflecting body, and, wherein, when the liquid crystal is arranged in the reflective surface of the reflecting body, the device further comprises (d) a power supply having a solar cell.

22. A device for reflecting electromagnetic waves, comprising:

(a) a dielectric lens having a focal length;

(b) an electromagnetic wave reflecting body;

(c) a position maintenance means, wherein the dielectric lens is transparent to electromagnetic waves selected from the group consisting of a first visible light wave band and a second radio wave band, wherein the reflecting body is provided in the focal length of the dielectric lens, and wherein the position maintenance means maintains a position of the reflecting body at the focal length of the dielectric lens, wherein the position maintenance means comprises a dielectric shell and a maintenance mechanism, and the reflecting body further comprises an electrically controlled reflecting body disposed to control electromagnetic waves; and (d) a power supply disposed in the electrically controlled reflecting body and having a solar cell, wherein the position maintenance means comprises a dielectric shell and a maintenance mechanism, wherein the dielectric shell is transparent to electromagnetic waves selected from one or more of the group consisting of a second visible light wave band and a second radio wave band, and the dielectric shell has a surface defining an inside diameter or an outer diameter equal to the focal length, wherein the dielectric shell is formed by a member transparent to electromagnetic waves selected from the group consisting of the second visible light wave band and the second radio wave band, and wherein the dielectric shell forms a hollow sufficient in size to store the dielectric lens, wherein the maintenance mechanism is disposed to maintain a position of the dielectric shell and the dielectric lens so that the dielectric shell includes the dielectric lens, and the dielectric shell is locatable along the focal length of the dielectric lens.

23. A device for reflecting electromagnetic waves, comprising:

(a) a dielectric lens having a focal length;

(b) an electromagnetic wave reflecting body;

(c) a position maintenance means; and (d) a shade cap disposed to intercept sun rays irradiated by the dielectric lens by the position maintenance means, wherein the dielectric lens is transparent to electromagnetic waves selected from the group consisting of a first visible light wave band and a first radio wave band, wherein the reflecting body is provided in the focal length of the dielectric lens, and wherein the position maintenance means is disposed to maintain a position of the reflecting body at the focal length of the dielectric lens, and wherein the position maintenance means comprises a dielectric shell and a maintenance mechanism, wherein the dielectric shell is transparent to electromagnetic waves selected from one or more of the group consisting of electromagnetic waves of a second visible light wave band and a second radio wave band, and the dielectric shell has a surface defining an inside diameter or an outer diameter equal to the focal length, wherein the dielectric shell is formed by a member transparent to electromagnetic waves selected from the group consisting of the second visible light wave band and the second radio wave band, and wherein the dielectric shell forms a hollow sufficient in size to store the dielectric lens, wherein the maintenance mechanism is disposed to maintain a position of the dielectric shell and the dielectric lens so that the dielectric shell includes the dielectric lens, and wherein the dielectric shell is locatable along the focal length of the dielectric lens, and wherein either a color filter, a liquid crystal, or both the color filter and the liquid crystal, are arranged in a reflective surface of the reflecting body.

24. A device for reflecting electromagnetic waves, comprising:

(a) a dielectric lens having a focal length;

(b) an electromagnetic wave reflecting body; and (c) a position maintenance means, wherein the dielectric lens is transparent to electromagnetic waves selected from the group consisting of a first visible light wave band and a second radio wave band, wherein the reflecting body is provided in the focal length of a dielectric lens, wherein the position maintenance means is disposed to maintain a position of the reflecting body at the focal length of the dielectric lens, wherein the position maintenance means comprises a dielectric shell and a maintenance mechanism, wherein the dielectric shell is transparent to electromagnetic waves selected from one or more of the group consisting of electromagnetic waves of a second visible light wave band and a second radio wave band, wherein the dielectric shell has a surface defining an inside diameter or an outer diameter equal to the focal length, wherein the dielectric shell is formed by a member transparent to electromagnetic waves selected from the group consisting of the second visible light wave band and the second radio wave band, and the dielectric shell forms a hollow sufficient in size to store the dielectric lens, wherein the maintenance mechanism is disposed to maintain a position of the dielectric shell and the dielectric lens so that the dielectric shell includes the dielectric lens, and the dielectric shell is locatable along the focal length of the dielectric lens, and wherein either a color filter, a liquid crystal, or both the color filter and the liquid crystal, are arranged in a reflective surface of the reflecting body, and the position maintenance means includes a light scattering material formed from a material disposed to scatter light.

25. A device for emitting electromagnetic waves, comprising:

(a) a first dielectric lens having a focal length;

(b) an electromagnetic wave generating body; and (c) a position maintenance means, wherein the first dielectric lens is transparent to electromagnetic waves selected from the group consisting of a first visible light wave band and a first radio wave band, wherein the generating body emits electromagnetic waves, and is provided in the focal length of the first dielectric lens, and wherein the position maintenance means is disposed to maintain a position of the generating body at the focal length of the dielectric lens, wherein the position maintenance means comprises a cylindrical container and a maintenance mechanism, wherein the cylindrical container is formed by a member transparent to electromagnetic waves selected from the group consisting of a second visible light wave band and a second radio wave band, wherein the cylindrical container has a surface that defines an inside diameter or an outer diameter equal to the focal length, and the cylindrical container forms a hollow sufficient in size to store two or more dielectric lenses, and the cylindrical container includes the first dielectric lens, and wherein the maintenance mechanism is disposed to maintain a position of the cylindrical container and each of the two or more dielectric lenses so that the cylindrical container is locatable along the focal length of each of the two or more dielectric lenses.

26. A device for emitting electromagnetic waves according to claim 25, further comprising:

(d) either a color filter, a liquid crystal, or both the color filter and the liquid crystal, arranged in a generating side of the generating body.

27. A device according to claim 25, further comprising:

(d) a shade cap for said position maintenance means, wherein the shade cap is disposed to intercept sun rays directed to pass through said dielectric lens.

28. A device according to claim 25, further comprising:

(d) light-scattering material arranged with regard to said position maintenance means, wherein the light scattering material is formed from material disposed to scatter light.

29. A device according to claim 25, further comprising (d) a liquid crystal; and (e) a power supply comprising a solar cell.

30. A device for emitting electromagnetic waves, comprising:

(a) a dielectric lens having a focal length;

(b) an electromagnetic wave generating body; and (c) a position maintenance means, wherein the dielectric lens is transparent to electromagnetic waves selected from the group consisting of a first visible light wave band and a first radio wave band, wherein the generating body emits electromagnetic waves and is provided in the focal length of the dielectric lens, and wherein the position maintenance means is disposed to maintain a position of the generating body at the focal length of the dielectric lens, wherein the position maintenance means comprises i. a maintenance mechanism that is disposed to maintain a position of the dielectric lens; and ii. a cylindrical case having two ends and that includes the dielectric lens, wherein the maintenance mechanism is disposed to maintain a position of the dielectric lens so that the generating body is locatable along the focal length of the dielectric lens, and the maintenance mechanism is disposed at a first end of the case, and a second end of the case is either opened wide or is covered with a cover object formed by a member transparent to electromagnetic waves selected from the group consisting of a second visible light wave band and a second radio wave band.

31. A device for emitting electromagnetic waves according to claim 30, further comprising:

(d) either a color filter, a liquid crystal, or both the color filter and the liquid crystal, arranged in a generating side of the generating body.

32. A device according to claim 31, wherein, when the liquid crystal is present, the device further comprises:

(e) a power supply comprising a solar cell.

33. A device according to claim 30, further comprising:

(d) a shade cap for said position maintenance means, wherein the shade cap is disposed to intercept sun rays directed to pass through said dielectric lens.

34. A device according to claim 30, further comprising:

(d) light-scattering material arranged with regard to said position maintenance means, wherein the light scattering material is formed from material disposed to scatter light.

35. A device for emitting electromagnetic waves, comprising:

(a) a dielectric lens having a focal length;

(b) an electromagnetic wave generating body; and (c) a position maintenance means, wherein the dielectric lens is transparent to electromagnetic waves selected from the group consisting of a first visible light wave band and a first radio wave band, wherein the generating body emits electromagnetic waves, and is provided in the focal length of the dielectric lens, and wherein the position maintenance means is disposed to maintain a position of the generating body at the focal length of the dielectric lens, wherein the position maintenance means comprises i. a maintenance mechanism that is disposed to maintain a position of the dielectric lens; and ii. a cylindrical case having two ends and that includes the dielectric lens, wherein the maintenance mechanism is disposed to maintain a position of the dielectric lens so that the generating body is locatable along the focal length of the dielectric lens, and wherein the maintenance mechanism is disposed at a first end of the case, and wherein the case has a second end that is either opened wide or is covered with a cover object formed by a member transparent to electromagnetic waves selected from the group consisting of a second visible light wave band and a second radio wave band, and wherein a window is provided in the position maintenance means, and wherein either a color filter, a liquid crystal, or both the color filter and the liquid crystal, are arranged in the window.

36. A device functioning as a traffic signal using a dielectric lens, comprising:

(a) a dielectric lens having a focal length;

(b) an electromagnetic wave reflecting body having a reflective surface;

(c) a position maintenance means, wherein the dielectric lens is transparent to electromagnetic waves selected from the group consisting of a visible light wave band and a radio wave band, wherein the electromagnetic wave reflecting body is provided in the focal length of the dielectric lens, and wherein the position maintenance means is disposed to maintain a position of the reflecting body at the focal length of the dielectric lens, wherein the reflective surface of the reflecting body has a color filter of three kinds of colors arranged thereon;

(d) a rolling mechanism arranged with regard to the position maintenance means, wherein the rolling mechanism is disposed to rotate three reflecting bodies along a perpendicular axis of rotation; and (e) a power supply having a solar cell and that is arranged in the rolling mechanism.

37. A device functioning as a traffic signal using a dielectric lens according to claim 36, wherein the reflecting body has a slit, or the reflecting body comprises metal bits arranged to form the reflecting body.

38. A device functioning as a traffic signal using a dielectric lens according to claim 36, further comprising:

(f) a shade cap for the position maintenance means, wherein the shade cap is disposed to shield sun rays that would otherwise pass through the dielectric lens if the shade cap where not there.

39. A device functioning as a traffic signal using a dielectric lens according to claim 36, wherein either a color filter, or a liquid crystal, or both the color filter and the liquid crystal, are arranged in a window provided in said position maintenance means.

* * * * *